US010319279B2

(12) United States Patent
Wang et al.

(10) Patent No.: US 10,319,279 B2
(45) Date of Patent: Jun. 11, 2019

(54) SPATIAL TEMPORAL PHASE SHIFTED POLARITY AWARE DITHER

(71) Applicant: Apple Inc., Cupertino, CA (US)

(72) Inventors: Chaohao Wang, Cupertino, CA (US); Paolo Sacchetto, Cupertino, CA (US); Sheng Zhang, Milpitas, CA (US); Yang Li, Los Angeles, CA (US); Myung-Je Cho, San Jose, CA (US); Marc Albrecht, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 18 days.

(21) Appl. No.: 15/438,448

(22) Filed: Feb. 21, 2017

(65) Prior Publication Data

US 2017/0358255 A1 Dec. 14, 2017

Related U.S. Application Data

(60) Provisional application No. 62/349,591, filed on Jun. 13, 2016.

(51) Int. Cl.
*G09G 3/20* (2006.01)

(52) U.S. Cl.
CPC ..... *G09G 3/2055* (2013.01); *G09G 3/2022* (2013.01); *G09G 2320/0247* (2013.01); *G09G 2320/0666* (2013.01)

(58) Field of Classification Search
CPC ..... G09G 3/2003; G09G 2320/0242; G09G 3/2044; G09G 3/2055; G09G 3/3607; G09G 2320/0247; G09G 3/2074; G09G 3/2051; G06F 3/044; H04N 19/176
See application file for complete search history.

(56) References Cited

U.S. PATENT DOCUMENTS

| | | | | |
|---|---|---|---|---|
| 5,734,369 | A | 3/1998 | Priem et al. | |
| 6,727,913 | B2 | 4/2004 | Hoppenbrouwers et al. | |
| 7,609,277 | B2 | 10/2009 | Noel et al. | |
| 8,179,401 | B2 | 5/2012 | Ishii | |
| 2003/0063100 | A1* | 4/2003 | Wang | H04N 19/184 345/596 |
| 2009/0251483 | A1* | 10/2009 | Hsu | G09G 3/2055 345/589 |

(Continued)

*Primary Examiner* — Weiming He
(74) *Attorney, Agent, or Firm* — Kilpatrick Townsend & Stockton

(57) ABSTRACT

This application relates to performing certain dithering processes to eliminate display artifacts such as flicker, which can be caused by charge accumulation at the display. The dither process can be performed by a display controller that uses a group lookup method for identifying groups of dithering patterns that can be combined to expand a number of color values available to the display. The dither process can also be performed as a temporal process that incorporates groups of dithering patterns into frames and shifts a spatial arrangement of the groups of dithering patterns over a sequence of frames. Additionally, the dither process can incorporate counters that count the number of times a particular spatial arrangement of dithering patterns has been used in a sequence of frames in order that each spatial arrangement of dithering patterns will share an average count with other spatial arrangements over a sequence of frames.

19 Claims, 17 Drawing Sheets

(56) References Cited

U.S. PATENT DOCUMENTS

| | | | | |
|---|---|---|---|---|
| 2009/0303248 | A1* | 12/2009 | Ng | G09G 3/2055 345/596 |
| 2010/0207959 | A1* | 8/2010 | Qi | G09G 3/2055 345/597 |
| 2012/0133668 | A1* | 5/2012 | Harada | G09G 3/2003 345/589 |
| 2015/0279319 | A1 | 10/2015 | Zhu | |
| 2016/0379543 | A1* | 12/2016 | Furihata | G09G 3/2055 345/598 |

* cited by examiner

SPATIAL TEMPORAL PHASE SHIFTED POLARITY AWARE DITHER

CROSS-REFERENCE TO RELATED APPLICATION

This application claims the benefit of U.S. Provisional Application No. 62/349,591, filed Jun. 13, 2016, entitled "POLARITY AND ARBITRARY PRESENTATION TIME AWARE DITHER", which is incorporated by reference herein in its entirety.

FIELD

The described embodiments relate generally to dithering processes for a display device. More particularly, the present embodiments relate to performing certain polarity-aware dithering processes that eliminate display artifacts such as flicker.

BACKGROUND

Certain electronic devices incorporate high pixel-density display panels that require a high flux of data in order to display high quality video and images. In order to reduce the amount of data processing required to provide such high quality outputs, many computing devices employ certain graphics processing algorithms that render denser images with less data. However, many of the graphics processing algorithms can inadvertently cause display artifacts such as flicker, which can limit the lifespan of the display and be visually displeasing to a user of the computing device.

SUMMARY

This paper describes various embodiments that relate to dithering for display panels. In some embodiments a method is set forth for performing a dithering process. The steps of the method can include receiving input data corresponding to a spatial pattern of color values for a frame in a sequence of frames. A spatial pattern of color values can be a spatial arrangement of several color values, each color value has its most significant bits and least significant bits representing the color value. Hence, the spatial pattern of color values can also be represented by a spatial pattern of most significant bits and a spatial pattern of least significant bits. The steps of the method can further include selecting a phase based on a position of the frame in a sequence of frames. For example, if the frame is the first frame of the sequence of the frames, a first phase may be selected. The method can further include selecting a dither pattern based on the spatial pattern of the least significant bits and the selected phase, and providing output data that combines the spatial pattern of most significant bits and the dither pattern. In one case, the dither pattern can include a spatial pattern of binary values. The selected dither pattern can also be part of a group of dither patterns that have multiple phases and each dither pattern in the group is associated with an individual phase. In one instance, the group can be sub-divided into positive polarity frame dither patterns and negative polarity frame dither patterns, which are available alternatively for odd or even frames in a sequence of image frames.

In some aspects, a computing device is set forth as having a display panel and a processor that is connected to the display panel. The processor can be configured to compile display output data in accordance with dither patterns that are associated with different phases. The phases can be shifted over a sequence of image frames. In one case, the phase shift can include rearranging the spatial locations of the phases. In another case, the phase shift can include changing phase associated with a group of pixels over time. In other cases, the phase shift can include both spatial and temporal phase shift. Additionally, the display controller can include a memory that stores a lookup table having entries that provide correspondences between a combination of least significant bits and a group of dither patterns. In some cases, the group of dither patterns includes a first group of dither patterns that correspond to positive polarity frames and a second group of dither patterns than correspond to negative polarity frames. In some instances, the phase shift can include changing a first dither pattern to a second dither pattern within the same group of dither patterns, and the first dither pattern has a higher average luminance than the second dither pattern.

In one aspect, the computing device's display panel can be refreshed at different refresh rates. The processor can track a first count of the use of a first phase within a cycle, such as within a time limit. The processor can also track a second count of the use of a second phase within the cycle. Then, if the first count exceeds the second count within the cycle, a dither pattern associated with the first phase can be bypassed. As such, in a cycle of a variable refresh rate monitor, the dominance of a single phase can be minimized or eliminated.

In some other embodiments, a system is set forth as having a processor, and a memory that is configured to store instructions that when executed by the processor, cause the system to perform steps that include receiving an input corresponding to a first block of pixel data, and outputting a sequence of second blocks of pixel data in a sequence of frames. Each output second block of pixel data can be based on a block of dither pattern that is selected according to the first group of pixel data. And each block of dither pattern is associated with a phase. The phase can be shifted over the sequence of frames.

In some instances, the second blocks of pixel data can be associated with a block of 2×2 pixels, a block of 4×4 pixels, or a block of any N×N pixels. For larger block of pixels such as a block of 4×4 pixels, the block can include more than one sub-blocks of pixels. A phase can be selected for each sub-block and the selection of the phase in this situation can additionally be based on the spatial location of the sub-block within the larger block. In one case, the larger block of pixel data can be divided into four quadrants, there can be four phases, and a different individual phase is selected for each of the four quadrants.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements.

DETAILED DESCRIPTION

Figure 1A:
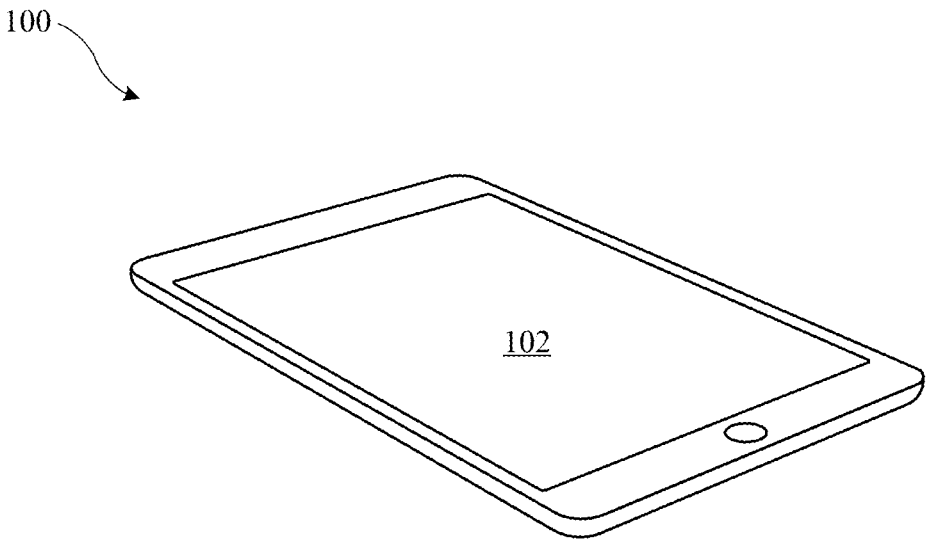
FIGS. 1A and 1B illustrate a computing device and a system diagram of the computing device.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

The described embodiments relate to dithering processes for expanding the number of bits-per-color (BPC) for a display. The dithering processes provided herein improve spatial variations of color while also mitigating charge accumulation, which can damage components of the display over time. Using dithering, display hardware that only has the capacity to process 8 bits (e.g., 256 gray levels or color levels) of colors can be perceived as having the capacity to display 10 bits (e.g., 1024 gray levels or color levels) or more of colors. As such, a RGB display device that processes 24 bits colors can be perceived as displaying 30 bits colors. By expanding the perceived BPC of a display, artifacts such as color banding, which can be described as the appearance of incidental horizontal or vertical lines of the same color on a display, can be eliminated. Such artifacts are eliminated by effectively providing more color steps between a series of adjacent pixels. Although mitigation of such artifacts through dithering can provide a more resilient and accurate display, some dithering algorithms can result in harmful charge accumulation and spatial color errors. The embodiments provided herein account for and eliminate such negative byproducts of dithering.

The embodiments set forth herein relate to dithering processes performed by a dithering module of a display controller. The dithering module can receive a group of two least significant bits (LSBs) of original pixel data for performing a particular dithering process. For example, the dithering module can collect LSBs for each pixel of a 2×2 spatial pattern of pixels (i.e., two pixels by two pixels) to create a 2×2 LSB block. The dithering module can then reference a lookup table for determining a luminance pattern, which can also be referred as a dither pattern, to use for displaying the 2×2 spatial pattern of pixels. The lookup table includes data that associates 2×2 LSB blocks with one or more dither patterns. For example, a 2×2 LSB block can be associated with four different discrete spatial-temporal dither patterns, and each of the spatial-temporal dither patterns is associated with a phase. Each of the four phases can be cycled in a sequence of frames. In addition, this process of dithering can be consistently expanded for dithering of larger blocks of pixels. For example, in a 4×4 block, each of the four phases can be used concurrently by spatial arranging the four phases in the 4×4 block. Then the spatial arrangement of four phases in the 4×4 block can change with each frame in order that, over time, the 4×4 block has a perceived average luminance corresponding to the original pixel data. In one case, the spatial rearrangement of the phases can include rotating the phases by 90 degrees clockwise or counterclockwise for each frame such that each 2×2 spatial-temporal dither pattern can be applied in a different block of the 4×4 block upon displaying at least four different frames. Furthermore, in some instances, a polarity (e.g., positive (+) or negative (−)) of the frame corresponding to the 2×2 LSB block can be used by the dither module to determine the spatial-temporal dither pattern to use. For example, a 2×2 LSB block can be associated with at least 4 odd frame phase patterns (one for each quadrant or 90 degree phase) and 4 even frame phase patterns. By considering polarity in this way, charge accumulation can be mitigated by cycling through different LSB blocks designed to balance charge between frames.

In some embodiments, one or more counters can operate with the dither module to help compensate for luminance error that can result from employing the dither module in a display that operates according to a variable refresh rate. For example, in variable refresh rate displays, certain frames can be displayed for different lengths of time depending on the refresh rate that is associated with the frame. Therefore, if a certain frame exhibits an unwanted artifact or luminance error, and that certain frame is displayed over multiple refreshes, the luminance error may be compounded over time. In order to mitigate such artifacts and luminance error, a duration counter can be employed by the dither module for each phase or 2×2 spatial-temporal dither pattern of each 4×4 block (a total of at least 4 counters for a 4×4 block). Furthermore, in some embodiments, a counter can be employed for each polarity of each phase (a total of at least 8 counters). For example, during an odd phase, a positive polarity frame may be output for a duration corresponding to 24 Hertz (Hz) and a first phase of a combination of dither patterns may receive a certain count. Thereafter, if the second, third, and fourth phases of the combination of dither patterns are displayed for shorter durations, then the first phase can subsequently be skipped such that the second phase, or a different phase, is displayed in place of the first phase. A count threshold can be associated with each count, such that, when the count for a particular phase and polarity pattern reaches or exceeds the count threshold, the particular pattern will be skipped until all remaining patterns also reach or exceed the count threshold. In this way, charge accumulation can be mitigated even when the refresh rate is changing.

In yet other embodiments of the dithering algorithms, spatial-temporal dither patterns can be adjusted according to an asymmetric panel response correction (PRC) module, where pixel data and polarity data is used to determine whether and how to adjust the pixel data for a set of frames. For a given 2×2 block of pixel data, the PRC module can determine how to modify the 2×2 block of pixel data for an odd frame and an even frame. For example, in order to mitigate charge accumulation, the PRC module can determine that a gray level of 128 should remain as 128 in a positive, odd frame, but be changed to 128.25 in a negative, even frame. As a result, the PRC can provide a 2×2 block of pixel data for an odd frame and a different 2×2 block of pixel data for an even frame. The 2×2 blocks corresponding to the odd frame and even frame can thereafter be individually referenced in a lookup table by the dither module to determine the spatial-temporal dither patterns to be used for each odd frame and even frame. For example, at least four spatial-temporal dither patterns for odd frames and at least four spatial-temporal dither patterns for even frames can be combined to create eight phases that will be output in multiple frames over time.

These and other embodiments are discussed below with reference to FIGS. 1A-11; however, those skilled in the art will readily appreciate that the detailed description given herein with respect to these figures is for explanatory purposes only and should not be construed as limiting.

In this specification, the term "block" denotes a group of multiple units and the term "cell" denotes an individual unit within a block.

Figure 1B:
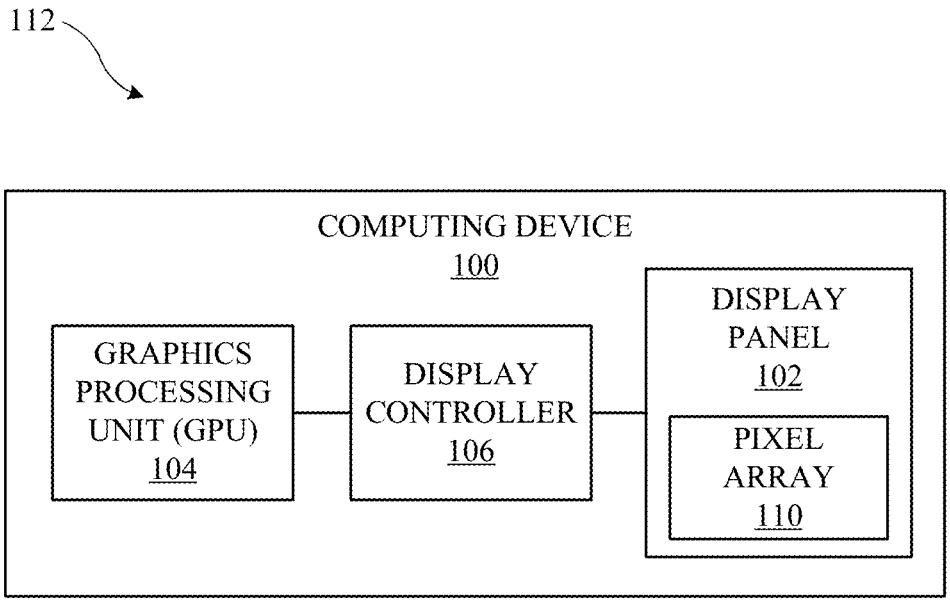

FIGS. 1A and 1B illustrate a computing device 100 and a system diagram 112 of at least some of the computing device 100. The computing device 100 can have a display panel 102 that includes a pixel array 110. The display panel 102 can use the pixel array 110 to output images at the display panel 102. It should be noted that the term display panel as used herein can refer to the display of a laptop computing device, tablet computing device, desktop computing device, media player, cellular phone, television, or any other electronic device incorporating an organic light emitting diode (OLED) display, light emitting diode (LED) display panel, or liquid crystal display (LCD). The images displayed by the display panel 102 can originate from image data provided by a graphics processing unit (GPU) 104 of the computing device 100. The GPU 104 can be connected to a display controller 106 that can be a system on a chip (SoC) or field programmable gate array (FPGA), each of which can include a processor and a memory for executing and storing program instructions. The display controller 106 can process image data from the GPU 104 and the resulting processed image data can be output by each pixel of the pixel array 110. The dithering processes described herein can be performed at a display controller 106, a graphics processing unit 104, or any suitable processors.

The display controller 106 and/or the display panel 102 can have a finite number of color values (e.g., 256 color values for 8 bits of image data). The term color value discussed here can sometimes also be referred as color level, gray level, or luminance level. The color value generally describes an intensity of a color. For example, for a 24-bit RGB display, each color red, green, or blue can have 8 bits of color values, i.e. 256 levels of color intensity. For RGB display, each pixel can have all three RGB colors with each color having its own color intensity, and the pixel is perceived as having a single color based on the combination of RGB color values. In order to expand the available number of color values, portions of the image data can be subjected to a dither module and/or a panel response correction (PRC) module of the display controller 106. The value of each color can be subjected to a dither module so that the color values for each color can be expanded. Hence, for a 24-bit RGB display having 8-bit capacity for each color, an additional of four finer color values (i.e. 2 bits) for each color value can expand the total color pallet to 30 bits.

Dithering is a process that the display panel slightly changes the color value of a pixel between two color values so that the pixel, on average, is perceived as displaying a finer color that falls between the two color values. For example, for intended color variations of 10 bits, a display may only be capable of displaying 8 bits of variations. Each 10-bit intended color value data has a data value that can be represented by a series of 10 binary values, which can also be separated by its most significant bits (MSBs) and least significant bits (LSBs). In one case, the data value may be 128.25. The integral value of 128 can be represented by MSBs while the decimal value of 0.25 can be represented by LSBs. And the finest color value the display panel may display for a pixel is in the increment of integral values. In other words, each pixel may only display 0, 1, 2, . . . , 127, 128, 129, . . . , 254, or 255. A pixel cannot display the color value of 128.25. Dithering is a process that the display panel slightly changes the color value between 128 and 129 so that the pixel, on average, is perceived as displaying a finer value of 128.25. The expansion of perceived color variations that include decimal values such as 128.25 is achieved by spatial and/or temporal dithering processes.

Figure 1C:
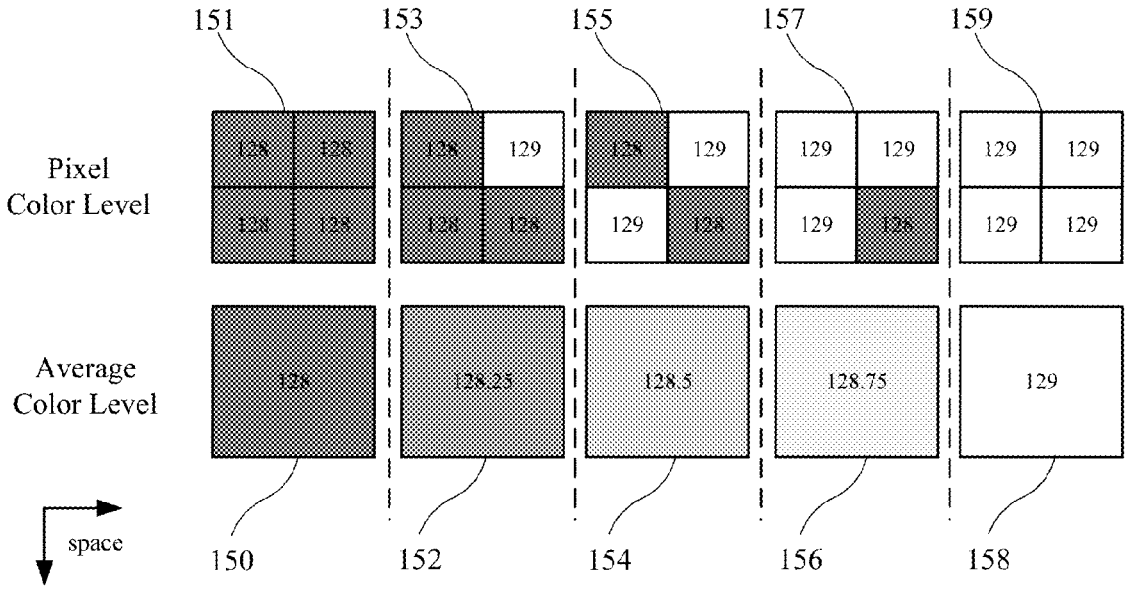
FIG. 1C illustrates a spatial dithering processing.

FIG. 1C illustrates a process of spatial dithering. Blocks 150, 152, 154, 156, and 158 are blocks of pixels that can each comprise 2×2 pixels. In the row "Average Color Level," the numerical values with decimals represent a desired color value in a range of n+2-bit colors. In the row "Pixel Color Level," the integral values represent an output color value at a particular pixel in a range of n-bit colors. For example, the numerical value of 128.25 represents a desired color value in a range of 10-bit color while the integer in the "Pixel Color Level" row 128 represents an actual output color value in a range of 8-bit color at a particular pixel. In the "Average Color Value" row, the integral value before the decimal represents the numerical value of the MSBs of the color data value and the decimals, which can be in the increment of 0.25, represent the LSBs of the color data value. Since each pixel is limited by displaying n-bit of colors, it can only display a color corresponding to an integral color value, such as either 128 or 129 but not 128.5. The extra n+2 bit incremental desired color is achieved by grouping several pixels into a block and displaying different integral color values in different pixels within the block. For example, if a color value of 128.5 is desired, the integral color values in a 2×2 pixel block can be spatially arranged like block 155. In block 155, two pixels are displaying a color value of 128 and two other pixels are displaying a color value of 129. Since each pixel is very tiny in the eye of users, on average, the users perceive the color value of the block 154 as 128.5. Similarly, if a color value of 128.75 is desired, the integral color values of a 2×2 pixel block can be arranged like block 157, in which three pixels are displaying a color value of 129 and one pixel is displaying a color value of 128. On average, the color value of block 156 is perceived as 128.75. By using spatial dithering, the numbers of color values can be expanded.

Figure 1D:
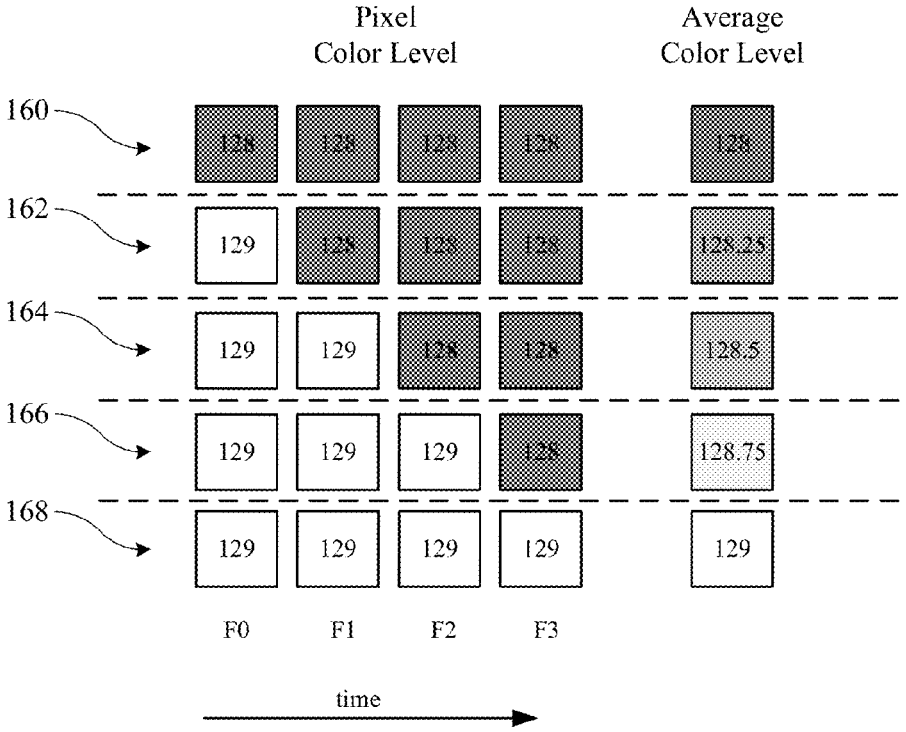
FIG. 1D illustrates a temporal dithering processing.

FIG. 1D illustrates a process of temporal dithering. Pixels 160, 162, 164, 166, and 168 may change their individual color value in frames F0, F1, F2, and F3 as time progresses. In the column "Average Color Level," the numerical values with decimals represent a desired color value in a range of n+2-bits colors. In the columns "Pixel Color Level," the integral values represent an output color value in a range of n-bit colors. For example, the numerical value of 128.5 represents a desired color value in a range of 10-bit color while the integer in the "Pixel Color Level" row 129 represents an output color value in a range of 8-bit color at a particular pixel. Similarly to spatial dithering described in FIG. 1C, the desired color values are expanded by certain bits, such as by two bits. The display of extra colors is achieved by slightly changing the integral color value of a pixel in different frames by a small integral increment, such as by 1. For example, for a desired color value of 128.25, pixel 162 may display color value of 129 in frame zero, F0, and display color value of 128 in F1, F2, and F3 in a series of four frames. Since the display is refreshing at multiple times per second, such as at a frequency of 120 Hz, users will perceive the color value of the pixel 162 as 128.25.

Using spatial and/or temporal dithering, the color values of the display controller 106 can be expanded. Although dithering can provide for a more robust pallet of colors for a display panel 102, dithering can also result in certain image artifacts such as flicker, as well as hardware degradation caused by charge accumulation. However, the embodiments set forth herein eliminate such negative aspects of dithering by employing dithers patterns that account for pixel polarity associated with image data and reduce average spatial variation from frame to frame.

Figure 2A:
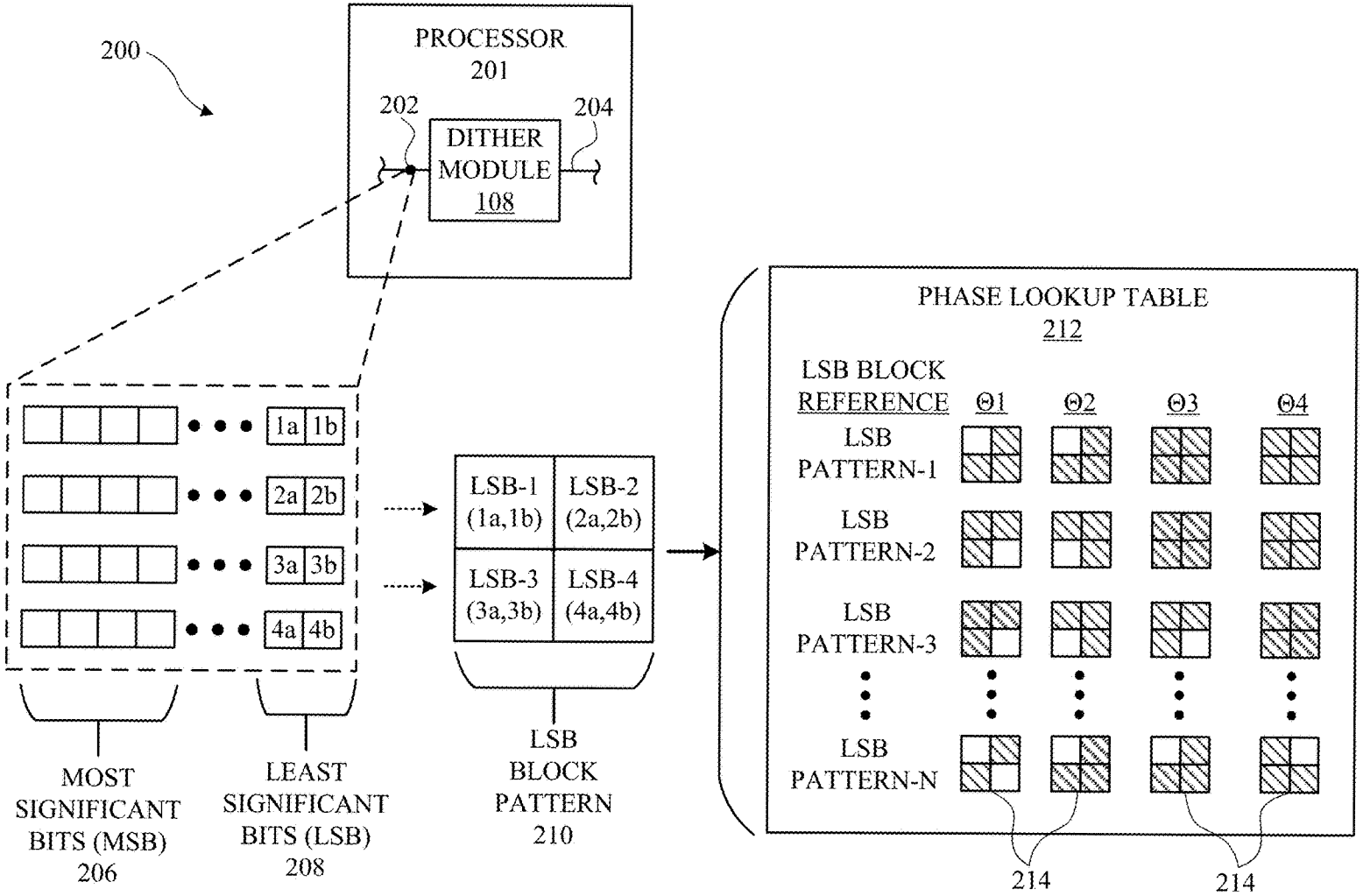
FIGS. 2A and 2B illustrate systems for performing a group lookup for dither patterns, and generating blocks of pixel data according to the group lookup.
Figure 2B:
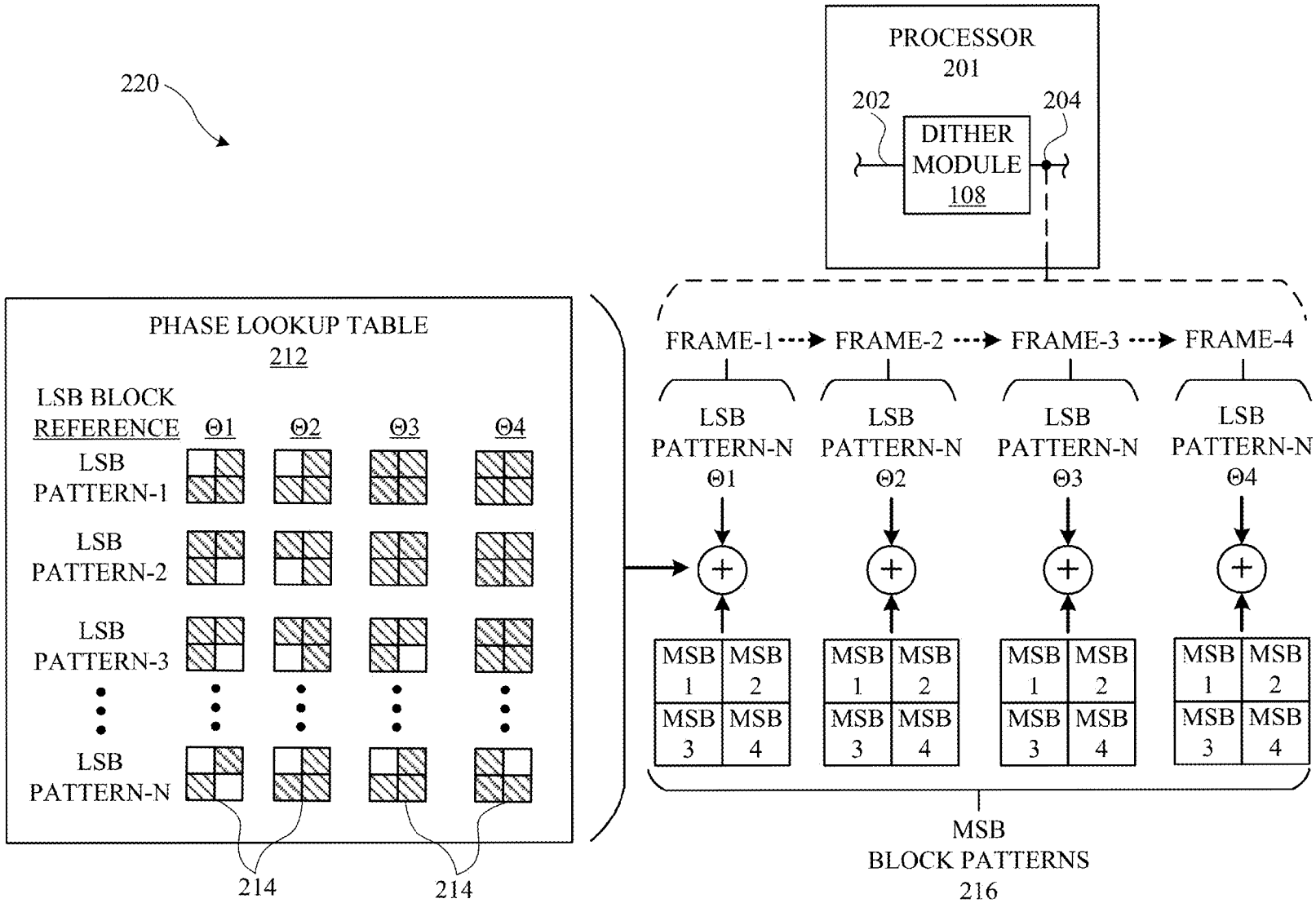

FIGS. 2A and 2B illustrate systems diagrams 200 and 220 for performing a group lookup for dither patterns, and generating blocks of pixel data according to a group lookup. Specifically, FIG. 2A illustrates the system diagram 200 that can include a processor 201 that performs dithering processes based on graphical input data 202. The graphical input data 202 can be provided from another module or circuit such as a frame buffer, pixel pipeline, scalar, and/or any other module or circuit suitable for providing an input signal to a dither module 108. In some cases, the graphical input data 202 can be generated in the processor itself based on other data sources. The processor 201 can be the GPU 104, the display controller 106 in FIG. 1B, a system on a chip, a field programmable gate array, or any suitable processor. The graphical input data 202 can be provided to the dither module 108 as discrete data corresponding to a group of values, each value having any number of bits. Each value in the individual graphical input data 202 may represent a desired color value for a pixel or a group of pixels at a particular frame.

Each value's bits include a number of most significant bits (MSB) 206 and a number of least significant bits (LSB) 208. A group lookup dithering process can be performed based on a group of pixels. By way of example, a particular graphical input data 202 can be associated with a group of pixels such as a 2×2 pixel block, as illustrated in FIG. 2A. Each pixel at a particular frame (i.e. at a particular time) has a desired color value, which is represented by a combination of MSB 206 and LSB 208. The four pixel's LSBs can be grouped as an LSB block pattern 210. Hence, for a 2×2 pixel block, the LSB block pattern 210 has four groups of LSBs. For a given LSB block pattern 210, the dither module 108 can refer to a phase lookup table to select a spatial-temporal dither pattern 214 in the table for later use that will be discussed in detail below.

For each LSB block pattern 210, there can be one or more spatial-temporal dither patterns 214 in the phase lookup table 212. In some instances, for each LSB block pattern 210 (e.g., each of LSB PATTERN-1 to LSB-PATTERN-N, where "N" is any number), there can be one or more phases of spatial-temporal dither patterns 214. In one case, the phase lookup table can have four phases. Each phase (e.g., Θ1, Θ2, Θ3, Θ4) can correspond to an individual image frame in a sequence of one or more frames and/or can correspond to a spatial location. In other words, each given LSB block pattern can have more than one spatial-temporal dither patterns, which are indexed by phases, available to choose. Hence, if the input LSB pattern is LSB PATTERN-3 and the phase is 2, a dither pattern of three darker pixels and one lighter pixel at the left-bottom corner will be selected. How a phase is selected will be discussed in detail below.

In one instance, the phase can be selected based on time so the phases of a pixel block are shifted over time. This allows a series of phase shifted spatial-temporal dither patterns 214 to be added to a set of frames. For example, in frame 1, the dither pattern of Θ1 will be displayed, in frame 2, the dither pattern of Θ2 will be displayed, and etc. Upon the four frames being displayed sequentially, each of the output patterns 214 for a given LSB block pattern is selected for further use that will be discussed in detail below.

In the phase lookup table, a white cell in a spatial-temporal dither pattern 214 can correspond to a discrete binary value of 1 and a black cell in a spatial-temporal dither pattern 214 can correspond to a discrete binary value of 0. The lookup table 212 can be stored in a memory of the processor 201, or otherwise accessible to the processor.

FIG. 2B sets forth a system diagram 220, which illustrates how each selected spatial-temporal dither pattern 214 selected from the phase lookup table 212 can be applied in a dithering process. A selected dither pattern 214 is added to a spatial pattern of MSBs, identified as MSB block patterns 216. A MSB block pattern 216 is an arrangement of the MSBs 206 of FIG. 2A in a group of pixels, such as a 2×2 pixel block. Since each pixel's color value has its MSBs and its LSBs, each group of pixels have its MSB block pattern 216 and the corresponding LSB block pattern 210. The corresponding LSB block pattern 210 is processed by the dither module 108, which in turn selects a spatial-temporal dither pattern 214 based on the LSB block pattern and the phase in the phase lookup table 212. The selected spatial-temporal dither patterns 214 can then be added (as indicated by the "+" symbol) to an MSB block pattern 216 and the added result can be an output for display panel 102 to display.

Figure 2C:
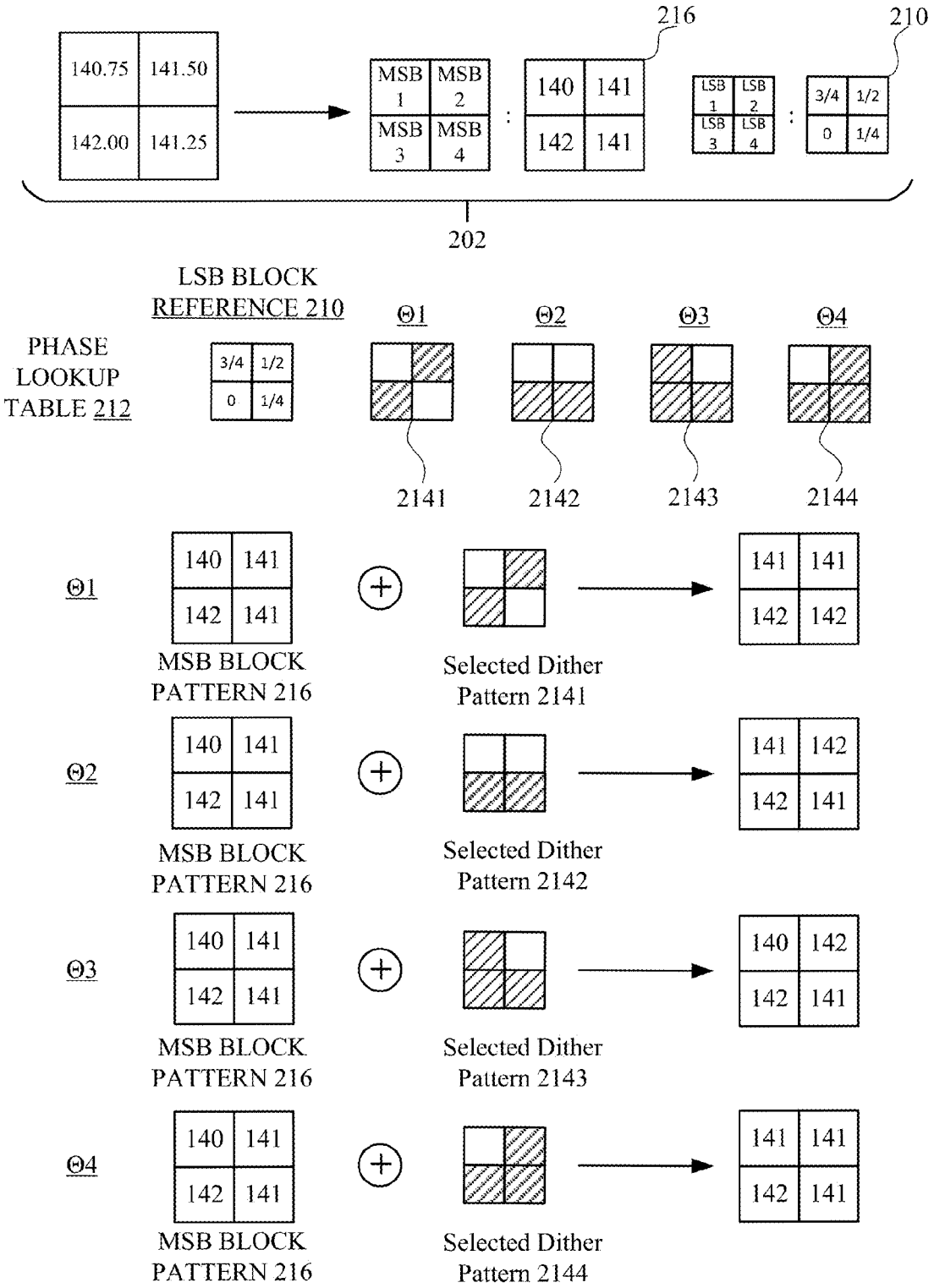
FIG. 2C illustrates a generation of blocks of pixel data based on combinations of dither patterns and most significant bit (MSB) patterns.

FIG. 2C illustrates how a selected spatial-temporal dither pattern 214 can be added to a MSB block pattern 216 to form an output for display panel 102 to display. For example, an example graphical input data 202 contains a group of four input color-value data, 140.75, 141.50, 142.00, and 141.25, representing the desired color values of a 2×2 pixel block. Using these data, a group of MSBs and a group of LSBs can be identified. The corresponding MSB block pattern 216 in this particular example having the values 140, 141, 142, and 141 because MSBs represent the integral values before the decimal point of the color value. Likewise, the corresponding LSB block pattern 210 is ¾, ½, 0, ¼ because LSBs represent the decimals. Based on the LSB block pattern, and turning to the phase lookup table 212 that has the LSB block reference of ¾, ½, 0, ¼, the spatial-temporal dither pattern 2141 can be selected (assuming phase 1 is used for this example). By adding the selected dither pattern 2141 to the MSB block pattern 216, the resulting output can be generated. For the cell corresponding to MSB1 of the MSB block patterns 216, the resulting color value after being added to the selected dither pattern 2141 will be 141. This is because there is a white cell, or binary 1 value, in the top left corner of the dither pattern 2141, so the resulting color value is 140+1, which is equal to 141. For the cell corresponding to MSB2 of the MSB block patterns 216, the resulting color value after the dither pattern 2141 being added will be 141. This is because there is a black cell, or binary 0 value, in the top right corner of the dither pattern 2141, so the resulting color value is 141+0. The resulting other cells (e.g., those corresponding to MSB3 and MSB4) will be 142 and 142 respectively. Therefore, the resulting output 204 will be 141 (MSB1), 141 (MSB2), 142 (MSB3), and 142 (MSB4).

For a sequence of frames as time progresses, a sequence of selected dither patterns 2141, 2142, 2143, and 2144 based on different phases can be individually added to the MSB block pattern 216 in a sequence of frames (e.g., Frame-1, Frame-2, Frame-3, Frame-4, etc.). Hence for Frame-1, which phase 1 is used, the resulting pattern will be 141 (MSB1), 141 (MSB2), 142 (MSB3), and 142 (MSB4) as discussed above. For Frame-2, phase 2 is used and dither pattern 2142 is selected. As such, the resulting pattern will be 141 (MSB1), 142 (MSB2), 142 (MSB3), and 141 (MSB4). Likewise, the resulting pattern for Frame-3 will be 140 (MSB1), 142 (MSB2), 142 (MSB3), and 141 (MSB4) and for Frame-4 will be 141 (MSB1), 141 (MSB2), 142 (MSB3), and 141 (MSB4). As a result of adding these spatial-temporal dither patterns 2141, 2142, 2143, and 2144, certain colors not previously provided in an 8-bit color pallet can be expressed once a cycle of phases have been output by the pixel array 110 within a period of time. And a perceived color of a portion of the frame corresponding to the LSB block pattern 210 will be a color corresponding to the color value for the graphical input data 202. As a result, by performing a group lookup of dither patterns according to FIG. 2A, a color pallet of the display controller can be expanded. For example, in some embodiments, although the display controller may only interpret 256 color values, the display controller can use the group lookup table of dither patterns as described and expand to receive at least 1024 color values (i.e., 10 bits).

Figure 2D:
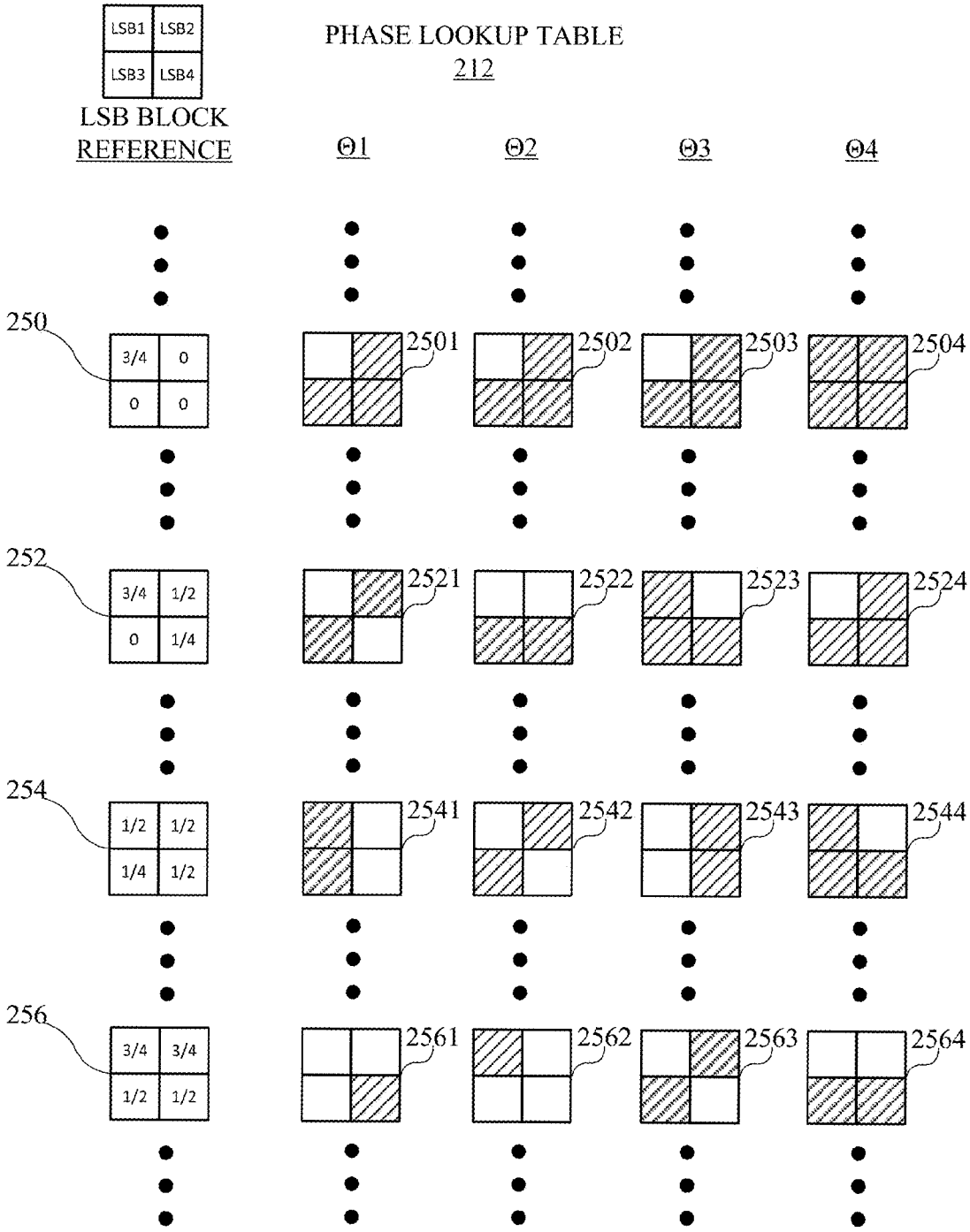
FIG. 2D illustrates examples dither patterns in a phase lookup table.

FIG. 2D illustrates how the spatial-temporal dither patterns in the phase lookup table 212 can be constructed. FIG. 2D shows several examples of LSB block references and their respective example spatial-temporal dither patterns for different phases. Each LSB block reference can correspond to a group of LSB pattern phases (e.g., Θ1, Θ2, Θ3, Θ4), which are predetermined patterns configured to reduce charge build up at the pixel array 110 while also eliminating display artifacts. Several rules may be followed to construct such a phase lookup table 212. First, for each LSB block, the average value of all phases for each corner should be equal to the desired LSB value at the corner. Hence, temporal average error can be eliminated as time progresses. For example, referring LSB block reference 250, the desired LSB-1 value is ¾. The dither patterns for LSB-1 across four phases (i.e. only looking at the cells at the top left corner) have three white cells and one black cell. The average value of all phases in this case is (1+1+1+0)/4, which is equal to the LSB-1 value. When all phases are displayed, an averaged color value will be perceived, which is equal to the intended LSB-1 value. In another example, referring to LSB block reference 254, the desired LSB-3 value is ¼. The dither patterns for LSB-3 across four phases (i.e. only looking at the cells at the bottom left corner) have one white cell and three black cells. Again, the average value of all phases in this case is (0+0+1+0)/4, which is equal to the LSB-3 value of LSB block reference 254.

Second, for each phase, the average value of the dithering pattern should be close to the average value of the LSB block reference. Hence, spatial dithering can be achieved and spatial average error can be minimized. For example, referring to LSB block reference 254, the average value of the LSB block reference is (½+½+¼+½)/4, which is equal to 0.4375. In phase 1, 2 and 3, each of the phase's average value of the dither pattern is 0.5 because each phase has two white and two black cells. The average value of the dither pattern is rather close, if not being equal, to the average value of the LSB block reference. Furthermore, when all phases are taken into account, the average value of the dithering patterns of all phases should be equal to the average value of the LSB block reference. Take LSB block reference 252 as an example. The average value of the LSB block reference is (¾+½+0+¼)/4, which is equal to 0.375. For all phases in the dithering patterns, there are 16 cells in total and there are 7 white cells. The average of the dithering patterns of all phases is equal to 7/16, which is also 0.375. By constructing the dithering patterns this way, when all phases are present in a larger block (as discussed in FIGS. 3A and 3B), the average spatial error can be zero or minimized.

Third, the dither patterns are sorted such that patterns with higher luminance are placed in the earlier phases and patterns with lower luminance are placed in the later phases (or vice versa). For example, referring to LSB block reference 254, three of the four patterns have two white cells while one pattern has only one white cell. Hence, the three patterns with two white cells have higher luminance than the pattern with only one white cell. Those three patterns are placed in the first three phases while the last pattern is placed in the fourth phase. Similarly, referring to LSB block reference 256. Two of the four patterns have three white cells while the other two patterns have two white cells. The higher-luminance patterns are placed in the first two phases while the lower-luminance patterns are placed in the last two phases. Sorting the patterns by luminance level can be helpful to reduce spatial average error and eliminate charge accumulation in manners that will be described in detail below.

Fourth, from phase to phase, the dither patterns are sorted such that the luminance difference between two consecutive phases is minimized. For example, referring to LSB block reference 250, the luminance level gradually decreases from three black cells to four black cells. Likewise, referring to LSB block reference 256, the luminance level gradually decreases from one black cells to two black cells. Preferably, the luminance level difference between two consecutive phases should be limited at one pixel difference at most.

Using one or more rules discussed above, a phase lookup table 212 can be constructed that can be used to reduce charge build up at the pixel array 110 while also eliminating display artifacts.

Because bits are binary, for a given N×N pixels there will have a finite number of combinations of LSB patterns. Each LSB pattern can be associated with an entry in a phase lookup table 212. For example, when there are N number of combinations of LSB patterns, there can be N number of LSB block references in the phase lookup table 212, as illustrated in FIG. 2A. The methods of constructing spatial-temporal patterns discussed herein may significantly reduce the size of the phase lookup table 212. In other words, even though there are N number of combinations of LSB patterns, there are fewer than N number of groups of spatial-temporal patterns required in the phase lookup table 212. For example, for a group of 2×2 pixels, LSB patterns can have 256 combinations (2 bits per LSB×4 LSBs=8; and 2^8=256 combinations) and the number of entries in the phase lookup table can be less than 100 (e.g., at least 24 LSB Patterns for 256 combinations).

Figure 2E:
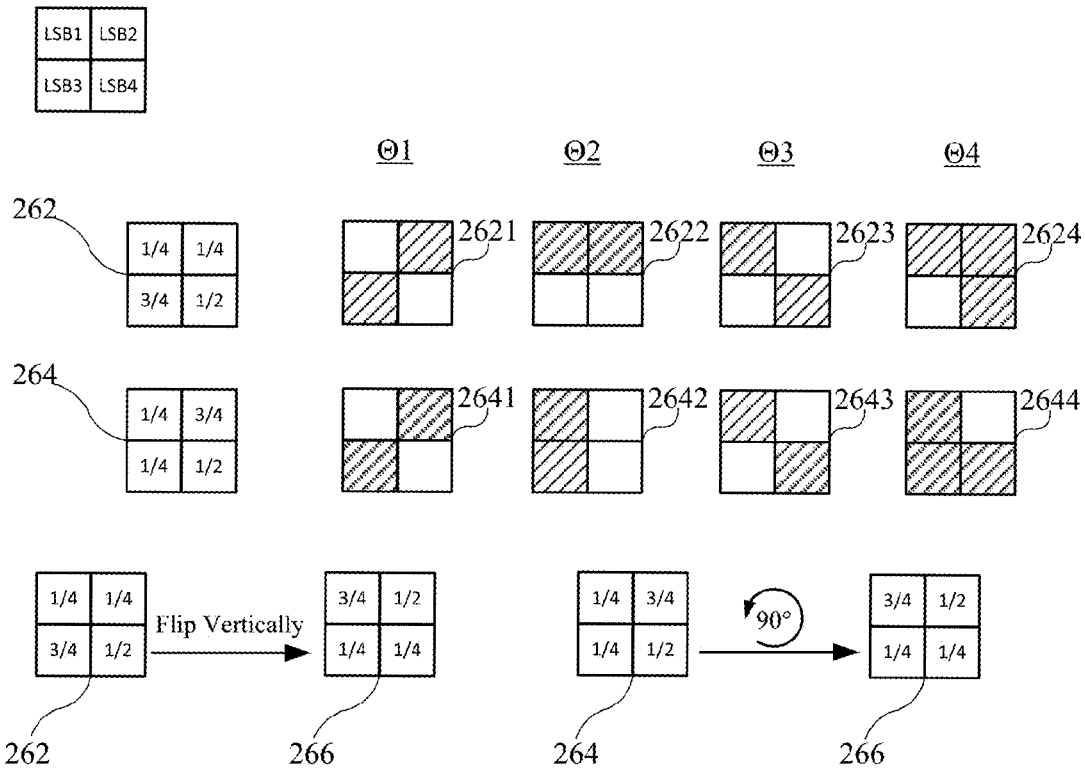
FIG. 2E illustrates a method to reduce the number of patterns in a phase lookup table.
Figure 2E:
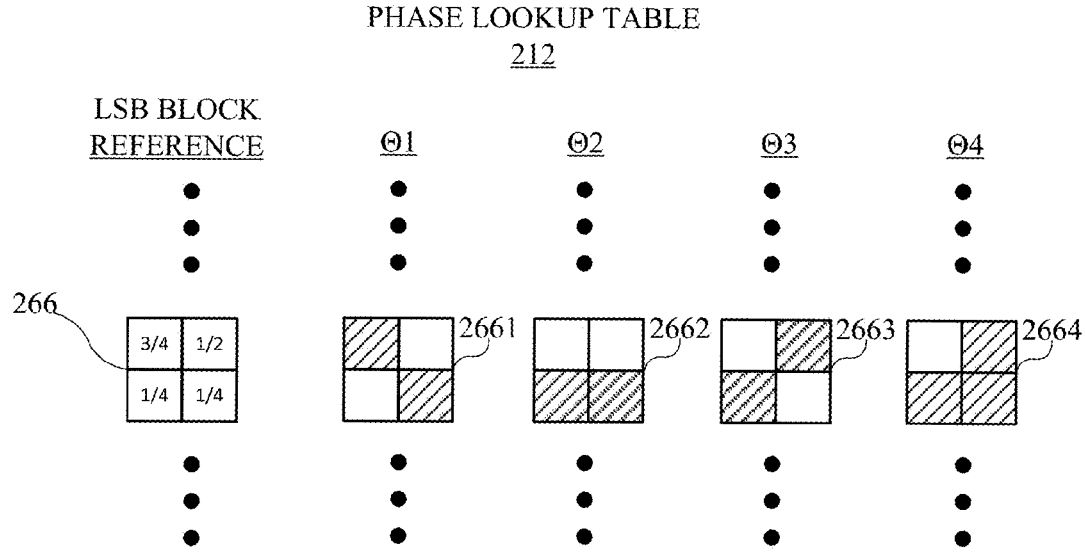

FIG. 2E illustrates how this reduction of the size of the phase lookup table 212 can be achieved. For example, a LSB pattern 262 having the values ¼, ¼, ¾, and ½ (in the order of LSB1, −2, −3, and −4) and a LSB pattern 264 having the values ¼, ¾, ¼, and ½ are different LSB patterns. But, in the phase lookup table 212, they can both be associated with the same LSB block reference 266, which has the value ¾, ½, ¼, and ¼. Comparing LSB pattern 262 and the LSB block reference 266 in the phase lookup table 212, although the two patterns are somewhat different, if the individual values of LSB pattern 262 are flipped vertically, the pattern will turn into the LSB block reference 266. Hence, when an input is a LSB pattern 262, the dither module 108 may still refer to the LSB block reference 266 to determine the dither patterns. The selected dither patterns can then be flipped vertically from the dither patterns actually stored in the phase lookup table 212 (compare dither patterns 2661, 2662, 2663, 2664 to dither patterns 2621, 2622, 2623, 2624). Likewise, comparing LSB pattern 262 and the LSB block reference 266 in the phase lookup table 212, although the two patterns are somewhat different, if the individual values of LSB pattern 264 are turned 90 degree, the pattern will become the LSB block reference 266. Hence, the dither mode 108 may still refer to the LSB block reference 266 to determine the dither patterns. The selected dither patterns can then be turned 90 degree from the dither patterns actually stored in the phase lookup table 212 (compare dither patterns 2661, 2662, 2663, 2664 to dither patterns 2641, 2642, 2643, 2644). It is understood that the exchange of position of the individual cells is not limited to flipping vertically or turning 90 degree, it can also be flipping horizontally, turning 180 degree, and individually exchanging the positions of corresponding cells. Using this process, the size of phase lookup table 212 can be significantly reduced because multiples LSB patterns can be associated with a single LSB block reference.

Figure 3A:
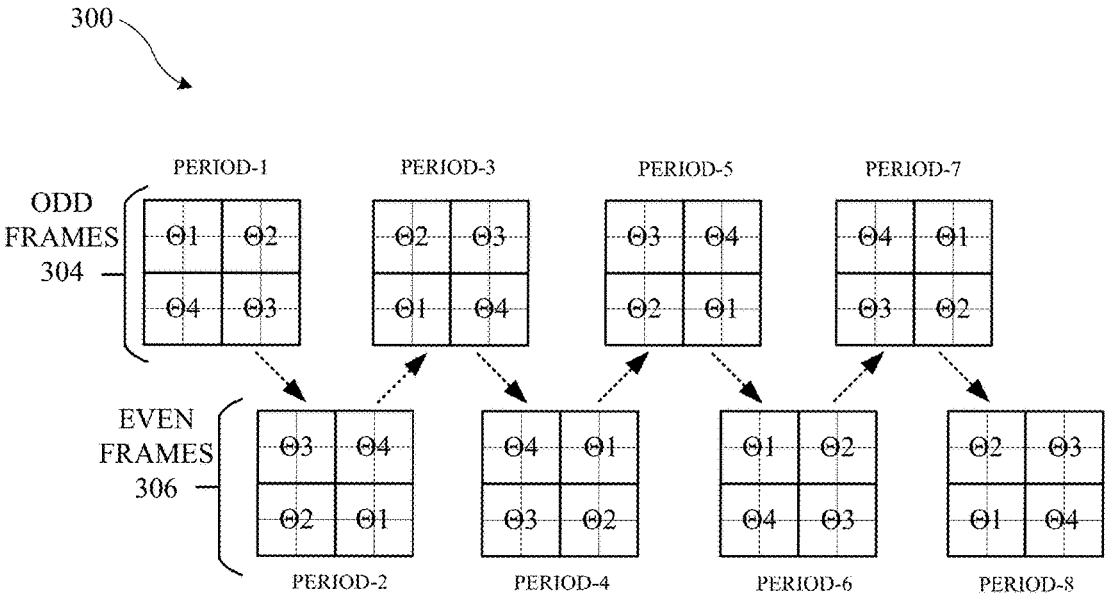
FIGS. 3A and 3B illustrate spatial-temporal phase shift processes in dithering.
Figure 3B:
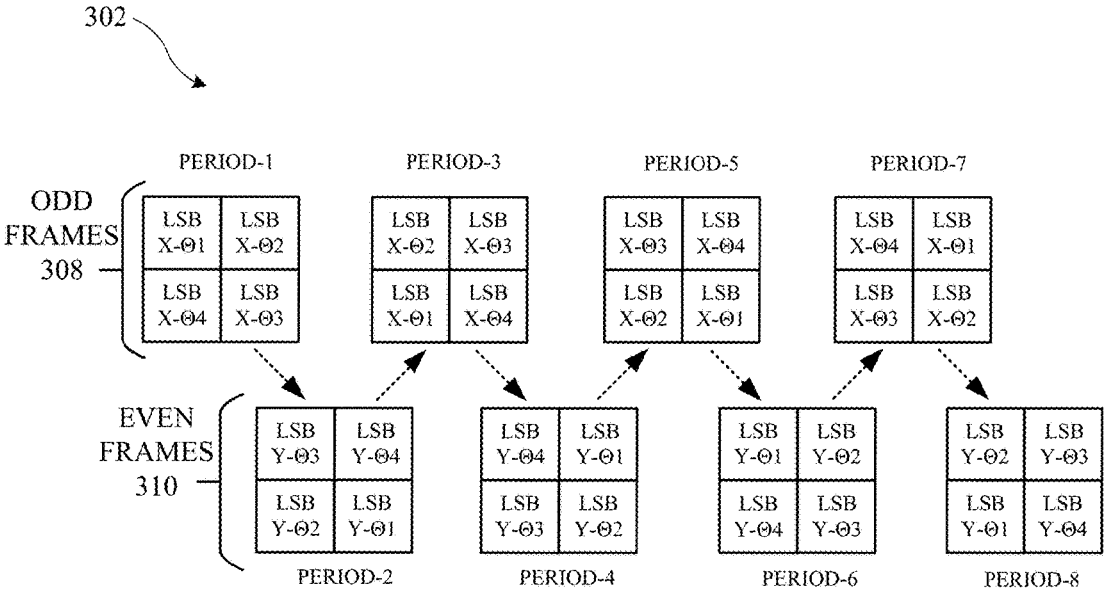

FIGS. 3A and 3B illustrate diagrams 300 and 302 of different embodiments for employing phase shifting in a spatial-temporal dithering process and expanding this dither process to larger blocks of pixels. FIG. 3A illustrates a diagram 300 that details, in one aspect of phase shifting, how different phases can be rearranged spatially in different frames depending on whether the frame is an odd frame (i.e., a positive frame) or an even frame (i.e., a negative frame). A group of pixels, such as a 4×4 pixel block, in a series of 8 frames are shown in FIG. 3A. The group of pixels is divided into four groups of 2×2 pixel blocks at four quadrants. For each 2×2 pixel block, the dither module 108 can select a dither pattern from the phase lookup table 212 based on the phase as indicated in FIG. 3A. All of the four phases (Θ1, Θ2, Θ3, Θ4) are used and are arranged spatially in a given frame. Using frame 1 of the period 1 as an example and referring both to FIG. 3A and to FIG. 2D, for the top left corner, if the input LBS pattern for that 2×2 pixel block is equal to LBS block reference 250 in FIG. 2D, the dither pattern 2501 will be selected because phase 1 is used for the top left corner quadrant as shown in FIG. 3A. Likewise, for the top right corner quadrant, if the input LBS pattern that 2×2 pixel block is equal to LSB block reference 254 in FIG. 2D, the dither pattern 2542 will be selected because phase 2 is used for the top right corner as shown in FIG. 3A.

Still referring to FIG. 3A, a series of 8 frames can be sequentially displayed and each frame of the 8 frames can be displayed for a period of time, as indicated by the Period-1 . . . Period-8 labels in FIG. 3A. The phases can be shifted both spatially based on the quadrants where the phases are located and temporally based on odd and even frames. During Period-1, when a first odd frame is to be presented by the pixel array 110, each phase can be arranged under the phase pattern under "Period-1." Subsequently, when a first even frame is to be presented by the pixel array 110, the arrangement of phase patterns can undergo a 180-degree phase shift. As a result, the phase at the top of the "Period-1" now appear in the bottom of the "Period-2" at the diagonal position. Furthermore, when a second odd frame is to be presented by the pixel array 110, the arrangement of the phase patterns can undergo another phase shift. The phase shift corresponding to "Period-3" causes the "Period-3" phase pattern to be shifted 90 degrees relative to the "Period-1" phase pattern (i.e. the phases are shift clockwise or anticlockwise by one quadrant). In addition, for each individual quadrant (see top left quadrant for example), the phase is also constantly shifting from frame to frame. This process of phase shifting in multiple manners results in a temporal combination of patterns that reduce charge accumulation and the appearance of color banding at the pixel array 110. Additionally, because four different phases are employed concurrently in a 4×4 block, any luminance error of one phase will be compensated by the perceived luminance provided in the other phases that are being concurrently employed.

By having such phase shift patterns both spatially and temporally, display artifacts such as flickering can be eliminated or minimized. As discussed above, dither patterns having different levels of luminance are sorted by phases in the phase lookup table 212. Generally speaking, if the dither patterns are sorted by decreasing luminance, dither patterns in lower phase tend to have a higher level of luminance. By having all phases present in a group of pixels, dither patterns from different phases are present in the group of pixels. As such, an extreme luminance level, which can be perceived as a flicker, can be minimized. Also, because different phases are present in a group of pixels, the spatial average error can be minimized and even eliminated. Moreover, by continuously phase shifting among frames so that the phases at a given group of pixel are continuously changing, a potentially dominant effect of a given phase can also be minimized. As a result, display artifacts and spatial average error are both minimized.

FIG. 3B illustrates a diagram 302 that details how different groups of LSB patterns can be arranged per frame according to whether a frame is an odd frame (i.e., a positive frame) or an even frame (i.e., a negative frame). For example, the phase lookup table 212 described herein can incorporate spatial-temporal dither patterns that are designated for odd frames and even frames. Therefore, a certain LSB pattern can correspond to at least two groups of spatial-temporal dither patterns in the phase lookup table 212—one group designated for odd frames and one group designated for even frames. For example, as illustrated in FIG. 3B, a group of spatial-temporal dither patterns identified as LSBX can be used for odd frames and a group of spatial-temporal dither patterns identified as LSBY can be used for even frames. The LSBX spatial-temporal dither patterns and the LSBY spatial-temporal dither patterns can include all different phase patterns, or, in some embodiments, one or more of the phase patterns can be the same. For example, LSBX can correspond to the spatial-temporal dither patterns in the same row as "LSB PATTERN-1" in the phase lookup table 212, and LSBY can correspond to the spatial-temporal dither patterns in the same row as "LSB PATTERN-3" in the phase lookup table 212.

The LSBX patterns can undergo a phase shift every other frame and the LSBY patterns can undergo a phase shift every other frame. For example, when a first odd frame is to be displayed by the pixel array 110, the LSBX pattern corresponding to "PERIOD-1" can be added to a corresponding MSB block pattern of the first odd frame, as discussed herein. Subsequently, when a first even frame is to be displayed by the pixel array 110, the LSBY pattern corresponding to "PERIOD-2" can be added to a corresponding MSB block pattern of the first even frame. Furthermore, when a second odd frame is to be displayed, the LSBX pattern corresponding to "PERIOD-1" can be phase shifted by 90 degrees, as provided in the "PERIOD-3" LSB block pattern, and added to a corresponding MSB block pattern of the second odd frame. Subsequently, when a second even frame is to be displayed, the LSBY pattern corresponding to "PERIOD-2" can be phase shifted by 90 degrees, as provided in the "PERIOD-4" LSB block pattern, and added to a corresponding MSB block pattern of the second even frame. Each of the spatial-temporal dither patterns can be generated, tested, and filtered, in order to isolate and store, in the phase lookup table 212, only those spatial-temporal dither patterns that reduce charge accumulation and luminance error, and eliminate display artifacts. Additionally, the spatial-temporal dither patterns can be filtered specifically for odd frames and even frames, in order to identify those spatial-temporal dither patterns that reduce charge accumulation and luminance error, and eliminate display artifacts for such frames.

Figure 4:
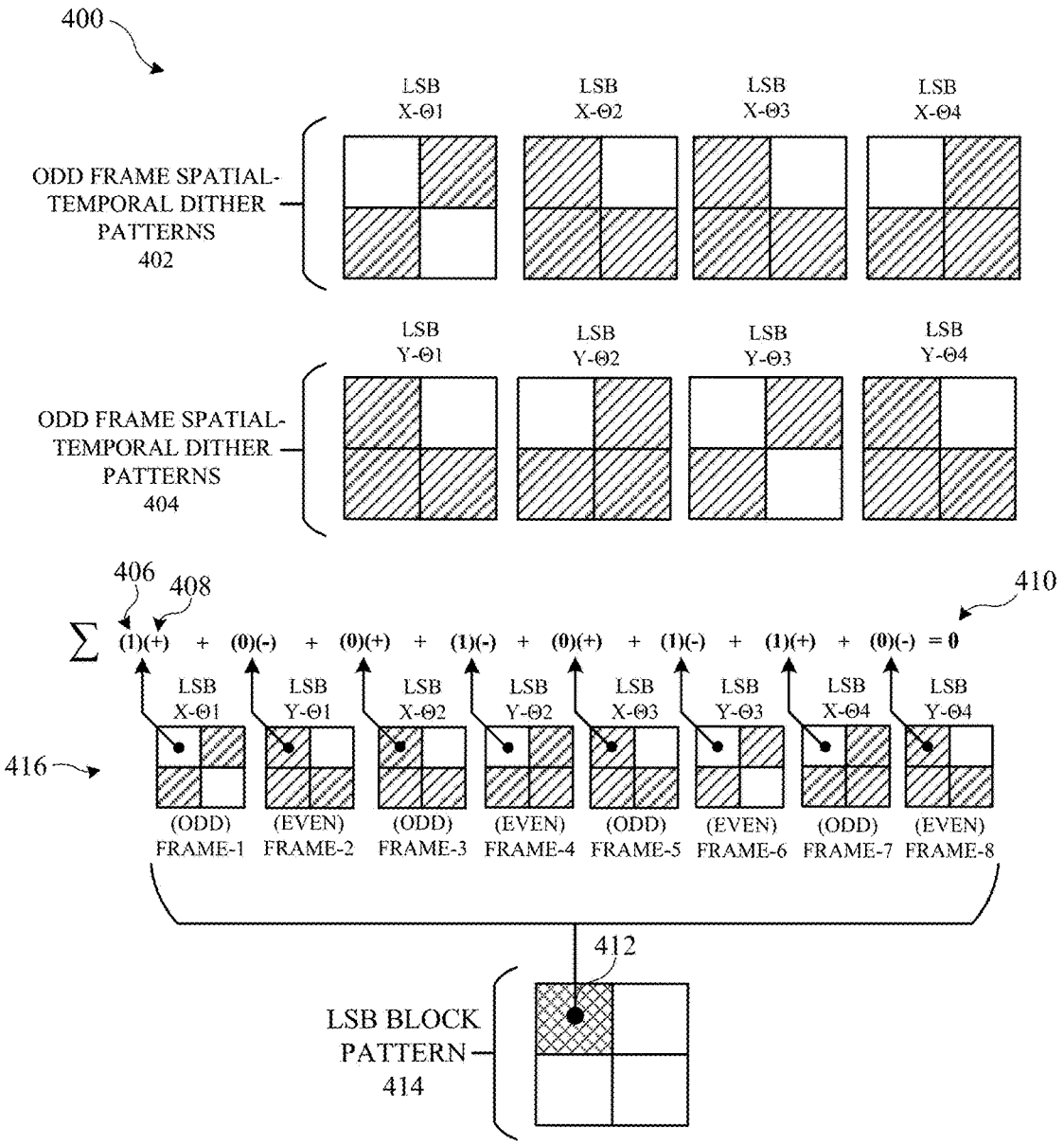
FIG. 4 illustrates a diagram that provides an example of how charge accumulation can be eliminated or mitigated using the spatial-temporal dither patterns discussed herein.

When a driving voltage is constantly applied to a display panel, characteristics of the display panel can be deteriorated. Hence, many display panels employ an inversion method that inverses the polarity (i.e. + or −) of pixels or a group of pixels from time to time or from frame to frame. Conventional dithering method can result in charge accumulation because the polarity of the pixels is not accounted and positive charges or negative charges may begin to build up. Charge accumulations can be perceived as flickers or other display artifacts. FIG. 4 illustrates a diagram 400 that provides an example of how charge accumulation can be eliminated or mitigated using the spatial-temporal dither patterns discussed herein.

Figure 3C:
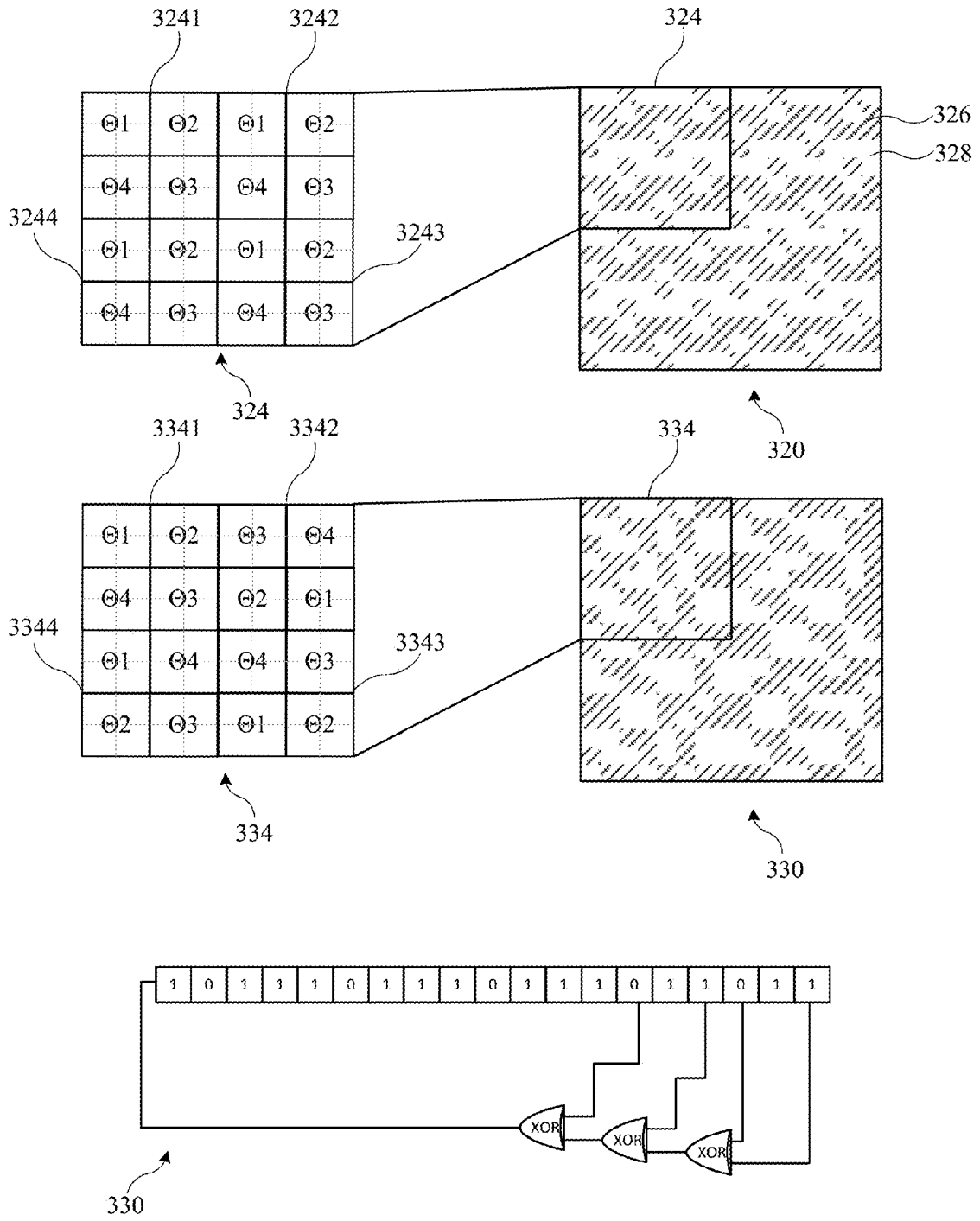
FIG. 3C illustrates a randomization process of spatial arrangement of phases among neighboring pixel blocks.

FIG. 3C illustrates a randomization process of the spatial arrangements of phases among neighboring pixel blocks. The randomization process can be employed to further reduce or eliminate display artifacts, especially in situations where a large area of solid color is displayed. Referring to block 320, it can represent a larger pixel block that is intended to display a solid color for the entire block. In this particular example, block 320 contains about 16×16 pixels and the intended color is at a half increment between two integral color values, for example 128.5. Since the intended color is at a half increment, there are approximately equal numbers of black cells (which may represent a color value of 128) and white cells (which may represent a color value of 129), as shown in block 320. Now referring to an 8×8 pixel sub-block 324, it is enlarged in FIG. 3C showing its spatial arrangements of different phases. The block 324 contains four 4×4 sub-blocks 3241, 3242, 3243, 3244. At a particular frame, each 4×4 sub-block 3241, 3242, 3243, 3244 may have the same spatial arrangement of Θ1, Θ2, Θ3, Θ4 in a clockwise direction as shown. And based on the spatial-temporal rearrangement method as described in FIG. 3A, the spatial arrangement of the phases for subsequent frames in those 4×4 sub-blocks 3241, 3242, 3243, 3244 may also be the same. In fact, the spatial arrangement of the phases in every 4×4 sub-blocks in the 16×16 block 320 may also be the same for subsequent frames. As a result, when a solid color is intended to be displayed for the entire large block 320, dither patterns will be repeated somewhat systematically and periodically, as shown in the dither pattern of block 320. In some situations, the repetitive dither patterns may incidentally create a pattern of alternating dark stripes 326 and bright stripes 328 or other sorts of repetitive patterns. The alternating stripes can be perceived by users as display artifacts, especially in a situation of a large area of a solid color because users may see alternating stripes across an area that is supposed to have a solid color.

A randomization process that can further reduce or eliminate display artifacts is illustrated by pixel block 330, which can also represent a 16×16 pixel block that, in this particular example, is intended to display a solid color with a value at a half increment, for example 128.5. Similar to block 320, since the intended color is at a half increment, there are also approximately equal numbers of black cells and white cells in block 330. However, as shown in the dither pattern of block 330, any repetitive dither patterns, dark stripes, or white stripes are eliminated. Hence, any potential display artifacts are also eliminated. The result of block 330 is achieved by employing a randomization process among neighboring sub-blocks, such as neighboring 4×4 blocks, so that the spatial arrangements of phases for neighboring 4×4 blocks are different from each other. Referring to 8×8 pixel block 332, it contains four neighboring 4×4 blocks 3341, 3342, 3343, 3344. For the first 4×4 block 3341, the spatial arrangement of phases is Θ1, Θ2, Θ3, Θ4 in a clockwise direction. However, spatial arrangement of phases in the second 4×4 block 3342 is not the same as that of block 3341. Instead, a randomization process using any suitable random method, such as a linear-feedback shift register (LFSR) pseudo randomization 330, can be used to randomize the spatial arrangement of phases in the second block 3342. Hence, its spatial arrangement of phases is Θ3, Θ4, Θ1, Θ2 in a clockwise direction. Similarly, randomization processes can be used for the third and fourth blocks 3343 and 3344. As such, their spatial arrangement of phases is Θ4, Θ3, Θ1, Θ2 and Θ1, Θ4, Θ3, Θ2 in a clockwise direction respectively. Similar randomization processes can be employed in each of the 4×4 blocks in the 16×16 block 330. In fact, similar randomization process can be employed for the entire display panel. Since the phase arrangements among neighboring pixel blocks are different, the corresponding dither patterns for neighboring pixel blocks are also different even for a large area of solid color. Hence, no repetitive patterns will be perceived by users.

After the randomization determination of spatial arrangements of phases for each 4×4 block, as time progresses, the 4×4 pixel blocks can follow the spatial-temporal phase shift method described in FIG. 3A. Since the initial spatial arrangements for a given 4×4 block is likely to be different from its neighboring blocks, the subsequent spatial arrangements for all those neighboring blocks remain to be different under the method described in FIG. 3A. In some embodiments, the randomization processes can also be applied temporally. In such cases, the spatial arrangement of each phase across different frames can be determined randomly.

Specifically, FIG. 4 illustrates a group of odd frame spatial-temporal dither patterns 402 that include at least four phases (LSB X-Θ1, LSB X-Θ2, LSB X-Θ3, LSB X-Θ4) and a group of even frame spatial-temporal dither patterns 404 that include at least four phases (LSB Y-Θ1, LSB Y-Θ2, LSB Y-Θ3, LSB Y-Θ4). Between groups 402 and 404, the patterns can be shifted two phases (i.e. LSB Y-Θ3 can be LSB X-Θ1 and etc.). Each group (402 and 404) is designed to eliminate charge accumulation when incorporated into a sequence of alternating odd and even frames. For example, FIG. 4 provides a sequence 416 of the spatial-temporal dither patterns for each illustrated group (402 and 404). Additionally, a binary value 406 and polarity 408 associated with a portion of each LSB pattern (e.g., LSB X-Θ1, LSB Y-Θ1, etc.) is illustrated. Over a sequence of 8 frames (FRAME-1 to FRAME-8), the charge sum 410 is zero for the portion of the LSB pattern (the upper left quadrant). A zero sum of charge is also shown in other portions (i.e. the other quadrants) of the LSB phases. Therefore, by accounting for the polarity of each frame, the total charge accumulation associated with a section 412 of an LSB block pattern 414 will be zero after the sequence of frames is output by the pixel array 110. The LSB block pattern 414 can be added to an MSB block pattern, as discussed herein, in order to expand a number of available colors of the dither module 108, without concern for any charge accumulating at the pixel array 110 as a result.

Furthermore, in some embodiments, once the LSB block pattern 414 and an MSB block pattern are combined, the resulting image data corresponding to their sum can be looped back into the dither module or another dither module in order to further expand the number of color values available to the display controller. For example, a first dither module can be an x-bit dither module that receives an n-bit input (e.g., 12 bits) and converts it to an x-bit output (e.g., 10 bits), when x is less than n. The x-bit output can thereafter be provided to a y-bit dither module that converts the x-bit input to a y-bit output, where y (e.g., 8 bits) is less than x. As a result, the display panel can realize a higher number of different colors values with less bits. The spatial-temporal dithering principle and process can be continuously applied to continuously expand the number of bits. In other words, higher bits dithering can be realized by applying the dithering algorithm in multiple stages. For example, by applying the same phase shift principle as illustrated in FIG. 3A, a 16×16 pixel block can be dithered using a group of four phase-shifted 4×4 pixel blocks, and each 4×4 pixel blocks can have a group of four phase-shifted 2×2 pixel blocks. While 2×2 pixel blocks and 4×4 pixel blocks are used as examples, it is understood that the group lookup dithering and phase shift processes described herein can be used in any N×N pixel blocks.

Figure 5:
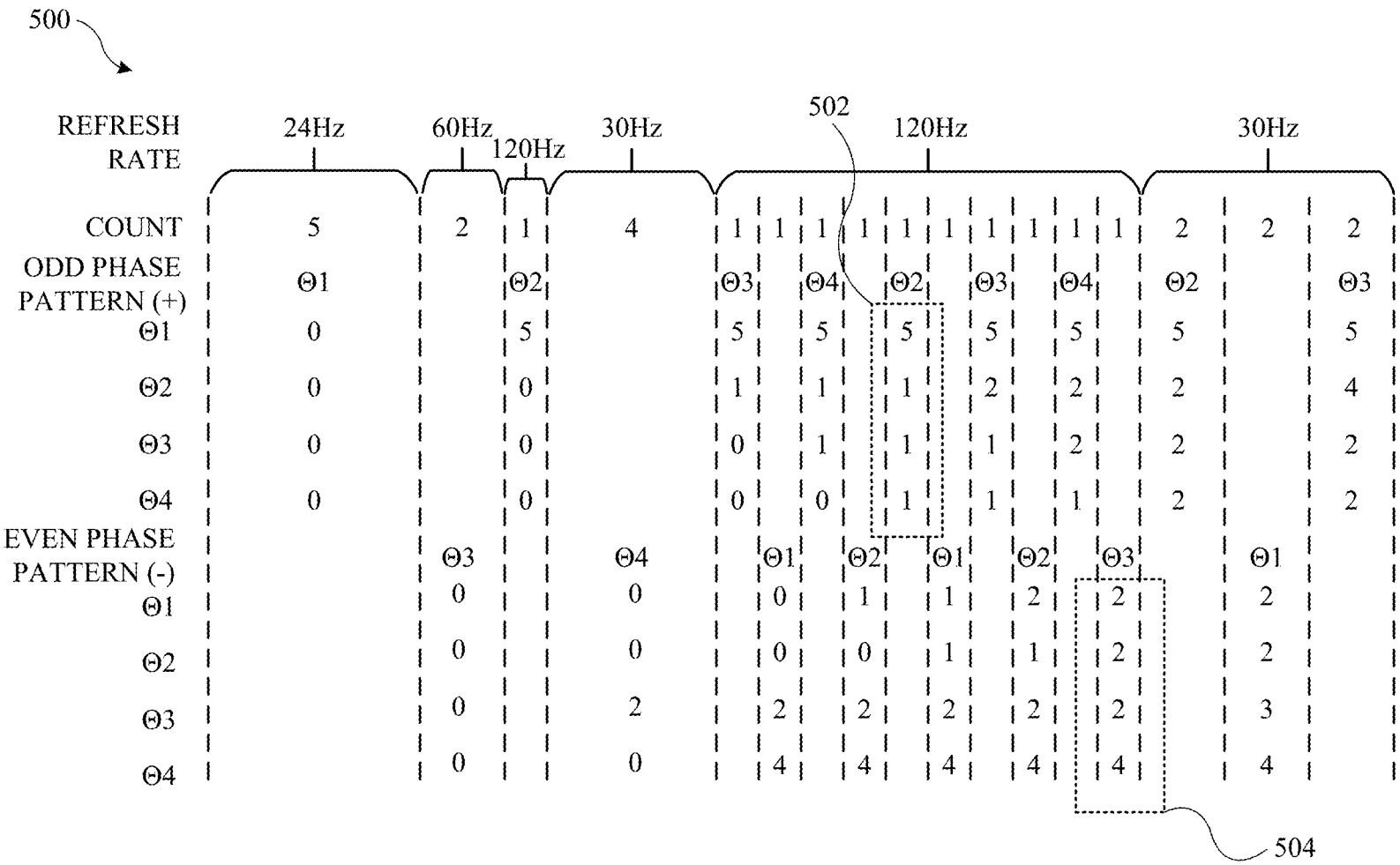
FIG. 5 provides an example how counters can be used for each phase pattern when operating under a variable refresh rate.

FIG. 5 illustrates a diagram 500 that details an embodiment that eliminates both charge accumulation and display artifacts at the pixel array 110 when a display device is operating under a variable refresh rate. In a display device that uses a variable refresh rate, some frames can be displayed for different lengths of time because the refresh rates associated with those frames may be lower than a typical refresh rate. In this situation, if one frame has some amount of error related to charge, spatial average error, or other display artifacts, and that frame is displayed for a long period of time, then that error will have a more dominant contribution to the visual effect perceived. When the display panel 102 is operating under a variable refresh rate, the dither module 108 of the processor 201 can use duration counters to keep track of how many times a particular phase has been used during a period of time or for a certain number of frames. Additionally, an upper limit or threshold can be set on the number of times each phase can be used within a certain period of time or certain number of frames. For example, four counters can be used to keep track of how long each phase has been displayed in a four-phase system. If a first frame that incorporates a first phase pattern has been displayed for a longer time than the other frames in a cycle of four phases, when it is time to repeat the cycle, the first phase can be bypassed. Furthermore, there can be an odd frame phase counter and an even frame phase counter. Therefore, even if a first odd phase frame is displayed for a long frame duration (e.g., 5 counts), the first even phase frame duration may not be as long and should therefore have a separate counter.

FIG. 5 provides an example how counters can be used for each phase pattern of an odd group of phase patterns and an even group of phase patterns when operating under a variable refresh rate. Initially, the display panel 102 can operate at a refresh rate of 24 Hz and a first odd phase dither pattern (θ1) can be used. Each count of the counter can correspond to a period of time, such as, but not limited to, 1/120 s (8.3 ms). In this way, because 24 Hz is a lower refresh rate than 120 Hz by a multiple of 5, the count for the first odd phase dither pattern (θ1) can be 5. The next time an odd frame is output by the display panel 102, the variable refresh rate can transition to 120 Hz and the second odd phase dither pattern (θ2) can receive a count of 1. Subsequent odd frames can be output at 120 Hz giving the third odd phase dither pattern (03) and fourth odd phase dither pattern (θ4) each a count of 1. At this point, the four-phase cycle of dither patterns has completed, but the number of counts per dither pattern phase is not equal, as indicated in the value enclosed by rectangle 502. In order to compensate for the differences in count of the dither pattern phases, the first odd phase dither pattern (θ1) can be bypassed during the subsequent frame in order that the second odd phase dither pattern (θ2) can receive another count. Thereafter, the third odd phase dither pattern (θ3) and fourth odd phase dither pattern (θ4) can be used during subsequent frames so that their counts can also be increased. This process of bypassing the first odd phase dither pattern (θ1) can be repeated until the second, third, and fourth odd phase dither patterns have each received a count that is equal to the first odd phase dither pattern (such as 5), or until the second, third, and fourth odd phase dither patterns are within a threshold boundary count of the first odd phase dither pattern (e.g., within two counts of a count of the first odd phase dither pattern).

Similarly, one or more counters can be used to ensure that the use of each even phase dither pattern is used in a way that no single phase can be dominating. Furthermore, the counters of the even phase dither patterns can be operated concurrently with the operation of the counters of the odd phase dither patterns. For example, as illustrated in FIG. 5, a counter can be employed for each even phase dither pattern. Initially, when the counters are reset in response to one or more of the counters reaching a threshold count, a third even phase dither pattern can receive a count of two when used in a frame having a refresh rate of 60 Hz. Subsequently, an odd frame can be displayed, followed by the fourth even phase dither pattern, which can be used in a frame having a refresh rate of 30 Hz. As a result, the fourth even phase dither pattern can receive a count of 4 (120/30). Thereafter, in subsequent even frames, the third even phase dither pattern and the fourth even phase dither pattern can be skipped until at least a count of the first or second even phase dither pattern has reached or exceeded a count of the third or fourth even phase dither pattern. For example, as can be seen in the values enclosed by rectangle 504, the third even phase dither pattern is no longer skipped in the next cycle of dither patterns once the first phase dither pattern has received a count of two. Subsequently, however, the fourth phase dither pattern is skipped because the fourth phase dither pattern has a count of four, and all of the other phase dither patterns have a count that is less than four. By concurrently counting phase patterns for odd and even frames, charge accumulation can be prevented through the even distribution of charge over the lifetime of the display panel 102, thereby preventing liquid crystal stresses and flicker. Also, any slight spatial average errors and other display artifacts associated a particular phase dither pattern will not have an exceedingly dominant effect on the overall display process because the duration of displaying that phase is accounted as described herein.

Figure 6:
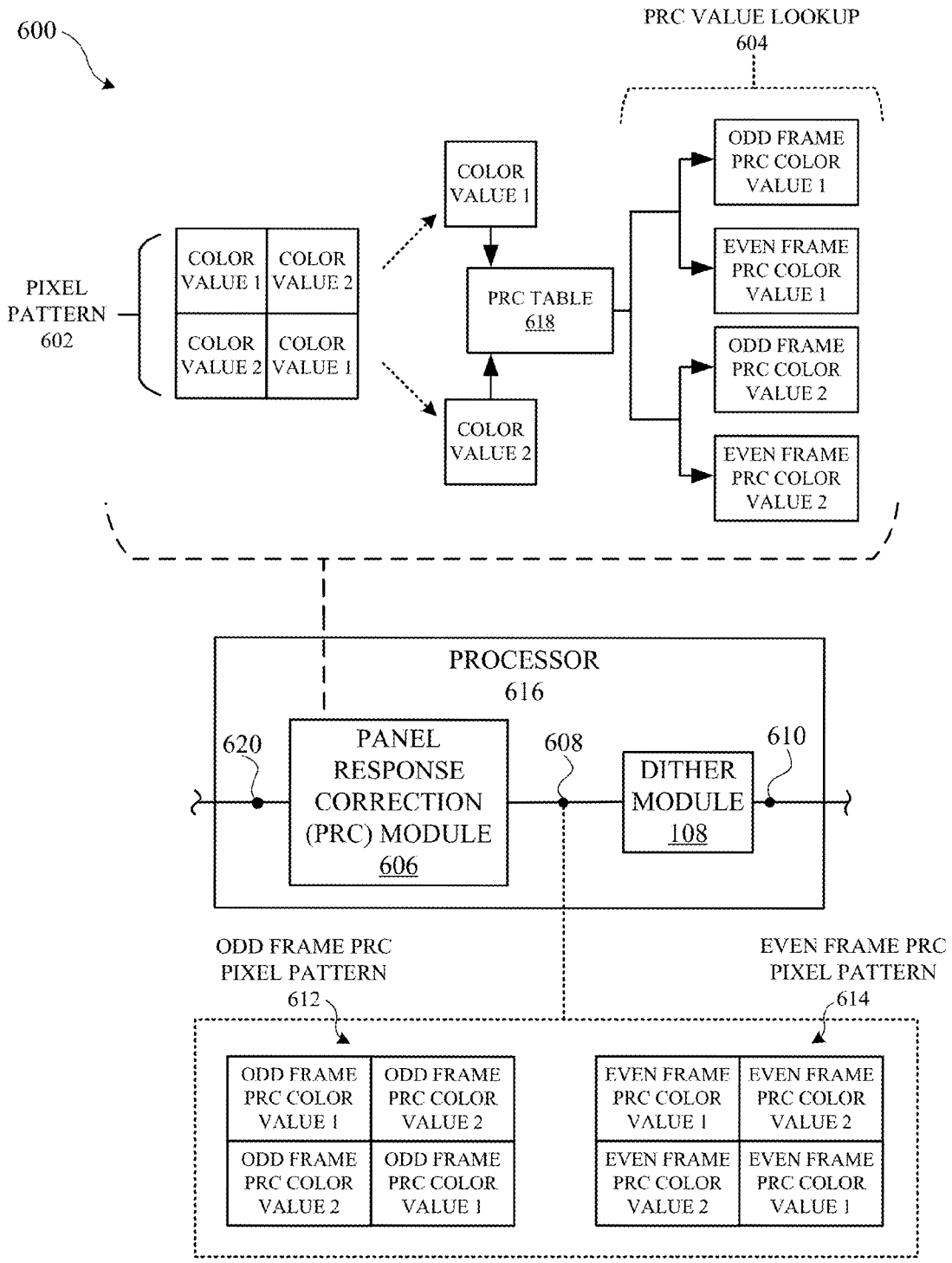
FIG. 6 illustrates a process of using asymmetric panel response correction (PRC) in combination with any of the dithering processes discussed herein.

FIG. 6 illustrates a diagram 600 that illustrates a process of using asymmetric panel response correction (PRC) in combination with any of the dithering processes discussed herein. The process can be performed by a processor 616, which includes a PRC module 606 and a dither module 108. The processor 616 can be the GPU 104, the display controller 106 in FIG. 1B, a system on a chip, a field programmable gate array, or any suitable processor. Each of the PRC module 606 and the dither module 108 can be embodied as analog or digital circuitry on the processor 616, or a program operating on the processor 616. The PRC module can receive pixel data 620, which represents the pixel pattern 602. The pixel data 620 can also include an indication of whether the pixel pattern 602 corresponds to an odd frame or an even frame. The pixel data 620 can be received from the GPU 104, or another module or component of the processor 616. The pixel pattern 602 can include multiple color values to be incorporated into a frame that can be output by the display panel 102. Each color value, COLOR VALUE 1 and COLOR VALUE 2, can be numerical values that are converted into signals for controlling the pixel array 110 of the display panel. The PRC module 606 can receive the pixel data 620 and access a PRC table 618 that includes entries that associate each color value of a number of color values with an odd frame color value and an even frame color value. Using the PRC table 618, the PRC module 606 can perform a PRC value lookup 604 to replace the color values of the pixel pattern 602 with the PRC color values provided in the PRC table 618. For example, COLOR VALUE 1 can correspond to an ODD FRAME PRC COLOR VALUE 1 and an EVEN FRAME COLOR VALUE 1, and COLOR VALUE 2 can correspond to an ODD FRAME COLOR VALUE 2 and an EVEN FRAME COLOR VALUE 2. Once the PRC color values corresponding to the pixel pattern 602 have been selected, an odd frame PRC pixel pattern 612 and an even frame PRC pixel pattern 614 can be created by the PRC module 606. Thereafter, the odd frame PRC pixel pattern 612 and/or the even frame PRC pixel pattern 614 can be provided to the dither module 108 to undergo one or more of the dithering processes as discussed herein. PRC module can provide positive or negative compensation based on the polarity of the frame. Conventional dithering processes cannot be performed satisfactorily using a PRC module. The dithering processes discussed herein can maintain the charge balance and the compensation characteristics in a PRC module because, as discussed above, the dithering processes account for both polarity and can provide dither patterns depending on odd or even frames.

Figure 7:
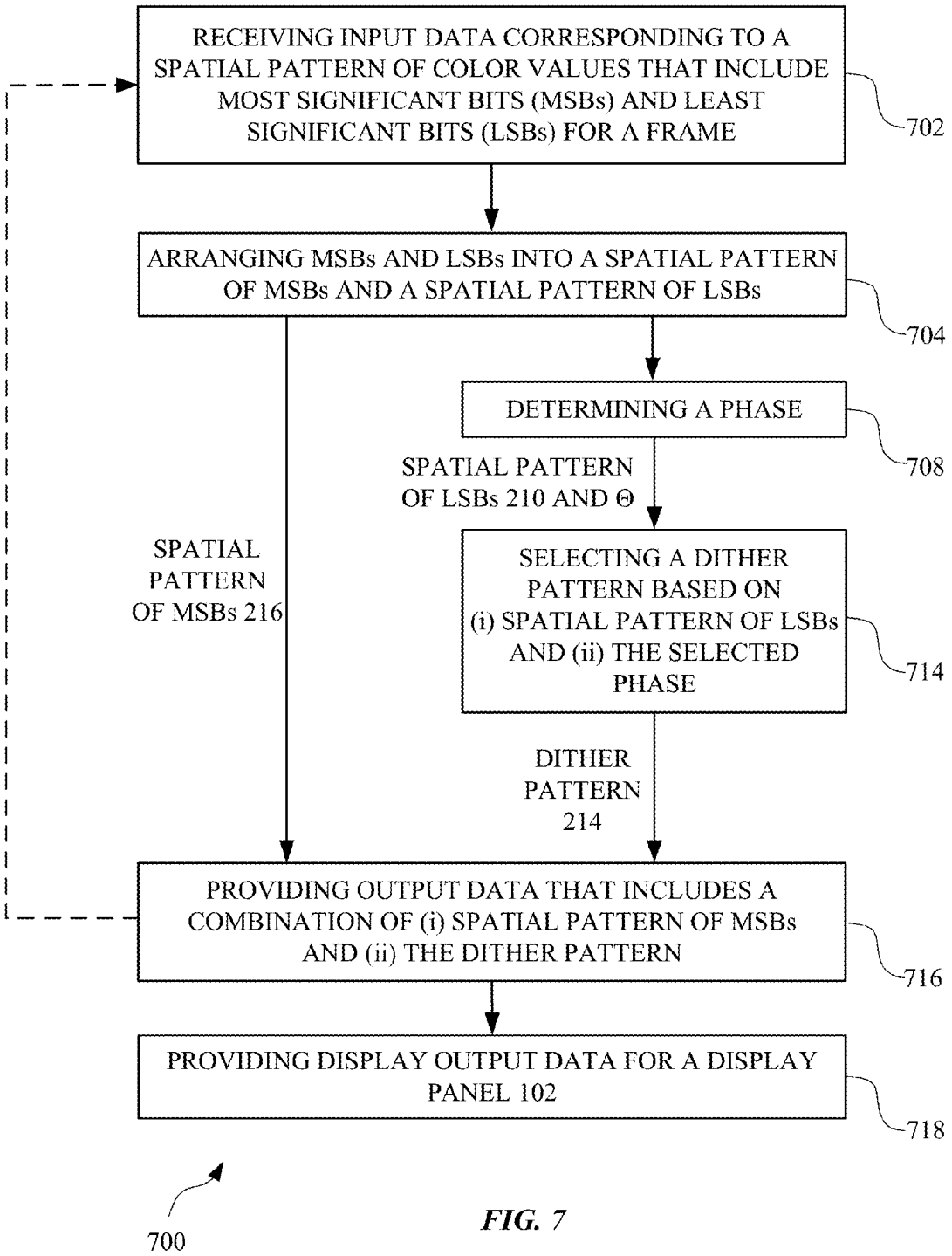
FIG. 7 illustrates a method for performing a dithering process on image data.

FIG. 7 illustrates a method 700 for performing a dithering process on image data. The method 700 can be performed by a dither module, graphics processing unit, display controller, FPGA, and/or any other apparatus suitable for processing image data. The method 700 can include a step 702 of receiving input data corresponding to a spatial pattern of color values for a frame in a sequence of frames. Each color value can be represented by most significant bits and least significant bits. Hence, at step 704, the spatial pattern of color values can be arranged into a spatial pattern of MSBs 216 and a spatial pattern of LSBs 210. And for a particular frame in a sequence of frames, a phase can be determined at step 708 based on different factors. In one case, the phase is based on an index of the frame in the sequence of the frames. For example, if the frame is the first frame in the sequence, phase 1 can be selected. In other cases, the phase is based on additional factors such as the spatial location of the pixel block, as illustrated in FIG. 3A. At step 714, after a phase is determined, a dither pattern 214 can be selected from multiple groups of dither patterns based on the spatial pattern of LSBs 210 and the selected phase. The multiple groups of dither patterns can be stored in a lookup table that includes groups of dither patterns for positive polarity frames and negative polarity frames. The method 700 can further include a step 716 of providing output data that includes a combination of the spatial pattern of MSBs 216 and the selected dither pattern 214. Then, data of display output can be transmitted to a display panel 102. Optionally, as indicated by the dotted line from step 716 to step 702, steps 702 through 716 can be repeated one or more times in order to further expand the number of color values that can be processed by the display controller dither module. For example, the color values can expand from 8 bits, to 10 bits, to 12 bits, to any other number of bits, depending on how many times the dithering process is repeated. Also, a spatial arrangement of the group of dither patterns can be phase shifted over a sequence of image frames.

Figure 8:
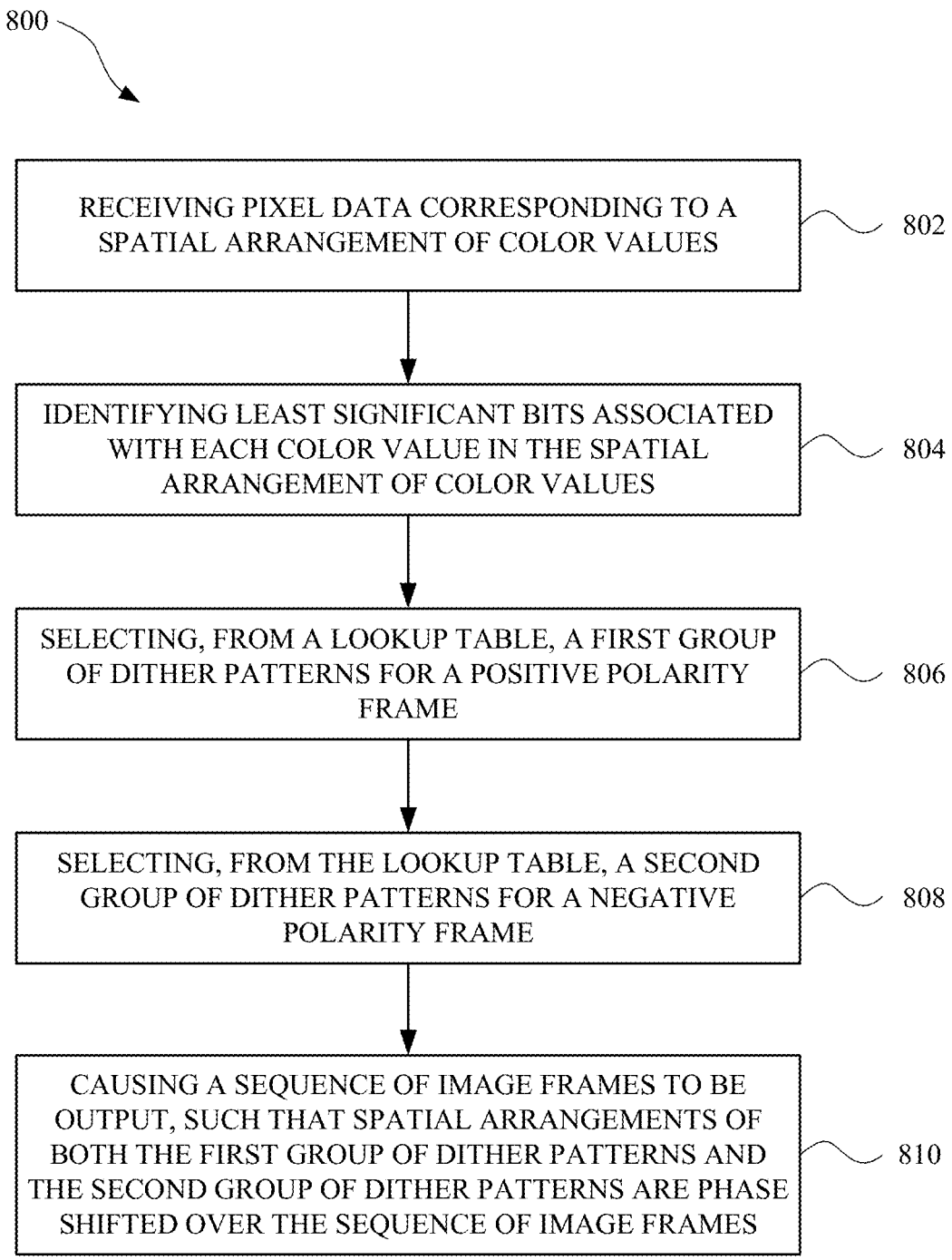
FIG. 8 illustrates a method for performing a dithering process on image data based on a polarity of a frame associated with the image data.

FIG. 8 illustrates a method 800 for performing a dithering process on image data based on a polarity of the frame associated with the image data. The method 800 can be performed by a dither module, graphics processing unit, display controller, FPGA, and/or any other apparatus suitable for processing image data. The method 800 can include a step 802 of receiving pixel data corresponding to a spatial arrangement of color values. At step 804, least significant bits associated with each color value in the spatial arrangement of color values are identified. The method 800 can also include a step 806 of selecting, from a lookup table, a first group of dither patterns for a positive polarity frame. At step 808, a second group of dither patterns are selected from the lookup table for a negative polarity frame. The method can further include a step 810 of causing a sequence of image frames to be output, such that spatial arrangements of both the first group of dither patterns and the second group of dither patterns are phase shifted over the sequence of image frames. Phase shifting the spatial arrangement of a group of dither patterns can include rotating or otherwise spatially rearranging each dither pattern in the group of dither patterns before the group of dither patterns are incorporated into an image frame.

Figure 9:
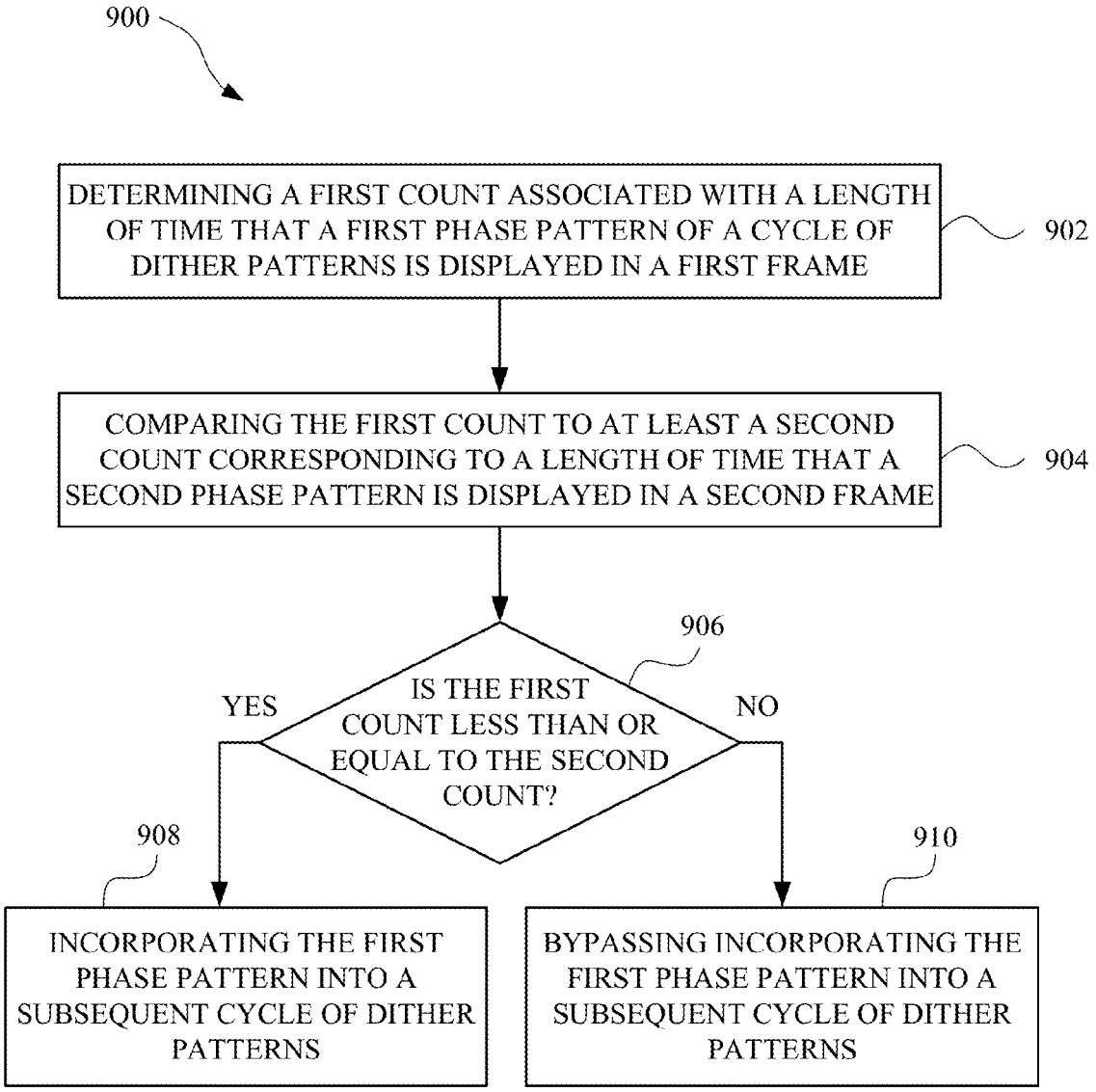
FIG. 9 illustrates a method for performing a dithering process that incorporates a counter for eliminating charge accumulation at a pixel array.

FIG. 9 illustrates a method 900 for performing a dithering process that incorporates a counter for eliminating charge accumulation at a pixel array. The method 900 can be performed by a dither module, graphics processing unit, display controller, FPGA, and/or any other apparatus suitable for processing image data. The method 900 can include a step 902 of determining a first count associated with a length of time that a first phase pattern of a cycle of dither patterns is displayed in a first frame. At step 904, the first count is compared to at least a second count corresponding to a length of time that a second phase pattern is displayed in a second frame. At step 906, as determination is made whether the first count is less than or equal to the second count. If the first count is less than or equal to the second count, the method 900 proceeds to step 908 where the first phase is incorporated into a subsequent cycle of dither patterns for one or more subsequent image frames. If the first count is greater than the second count, the method 900 proceeds to step 910, which includes bypassing incorporating the first phase pattern into a subsequent cycle of dither patterns for one or more subsequent image frames.

Figure 10:
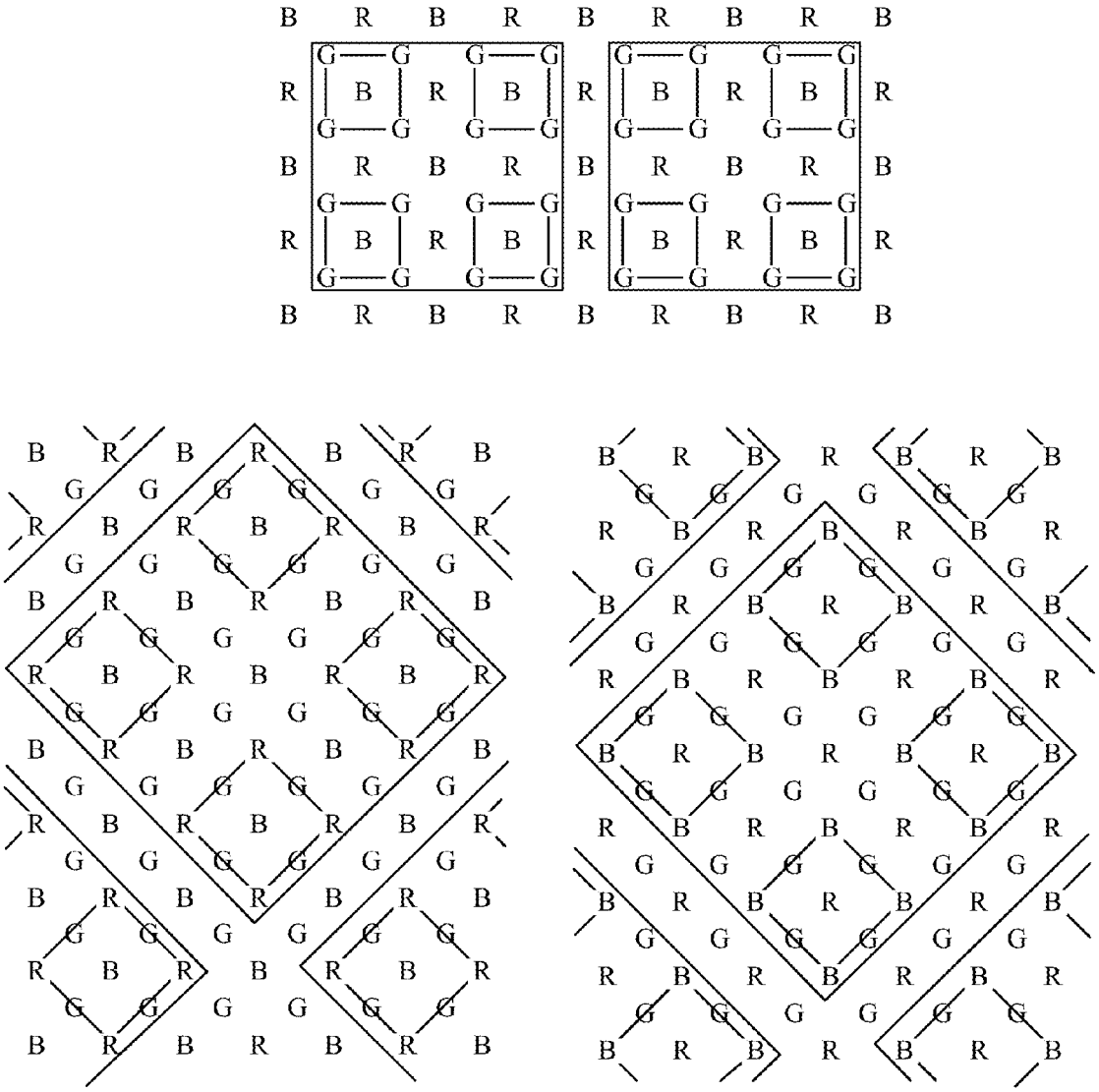
FIG. 10 illustrates dithering of three-color pixels in a display device.

FIG. 10 illustrates a pixel matrix of a display device and dither processes by color for the display device. The pixel matrix shown in FIG. 10 can represent a pixel matrix in any display devices. For example, it can be a Pentile type organic light-emitting diode (OLED). To increase pixel per inch and maximize pixel packing, the color pixels can be arranged in diagonal positions as shown in FIG. 10. The letters B, R, G denote the respective positions of the blue, red, green pixels in the pixel matrix. In some cases, the numbers of different color pixels can be different. For example, in the type of pixel matrix shown in FIG. 10, the numbers of blue and red pixels are half of the number of green pixels. Because of the pixel arrangement and the difference in numbers of pixels, the dithering process for the pixels for each color can be handled separately and differently. For denser color pixels (green in this particular case), the dithering processing can be performed horizontally and vertically by grouping the pixels in 2×2 pixel blocks for group lookups for dithering patterns, and having a phase-shifted spatial re-arrangement dithering using four 2×2 pixel blocks in a 4×4 pixel blocks. For less dense color pixels (such as red and blue in this particular case), the dithering processing can be performed diagonally by grouping 2×2 pixel blocks that have a diamond shape together for group lookups for dithering patterns, and having a phase-shifted spatial re-arrangement dithering using four 2×2 pixel diamond blocks in a 4×4 pixel diamond blocks. Because a display panel may control its pixel or pixels by rows and columns, a diagonal spatial dithering may require one or more line buffers.

Figure 11:
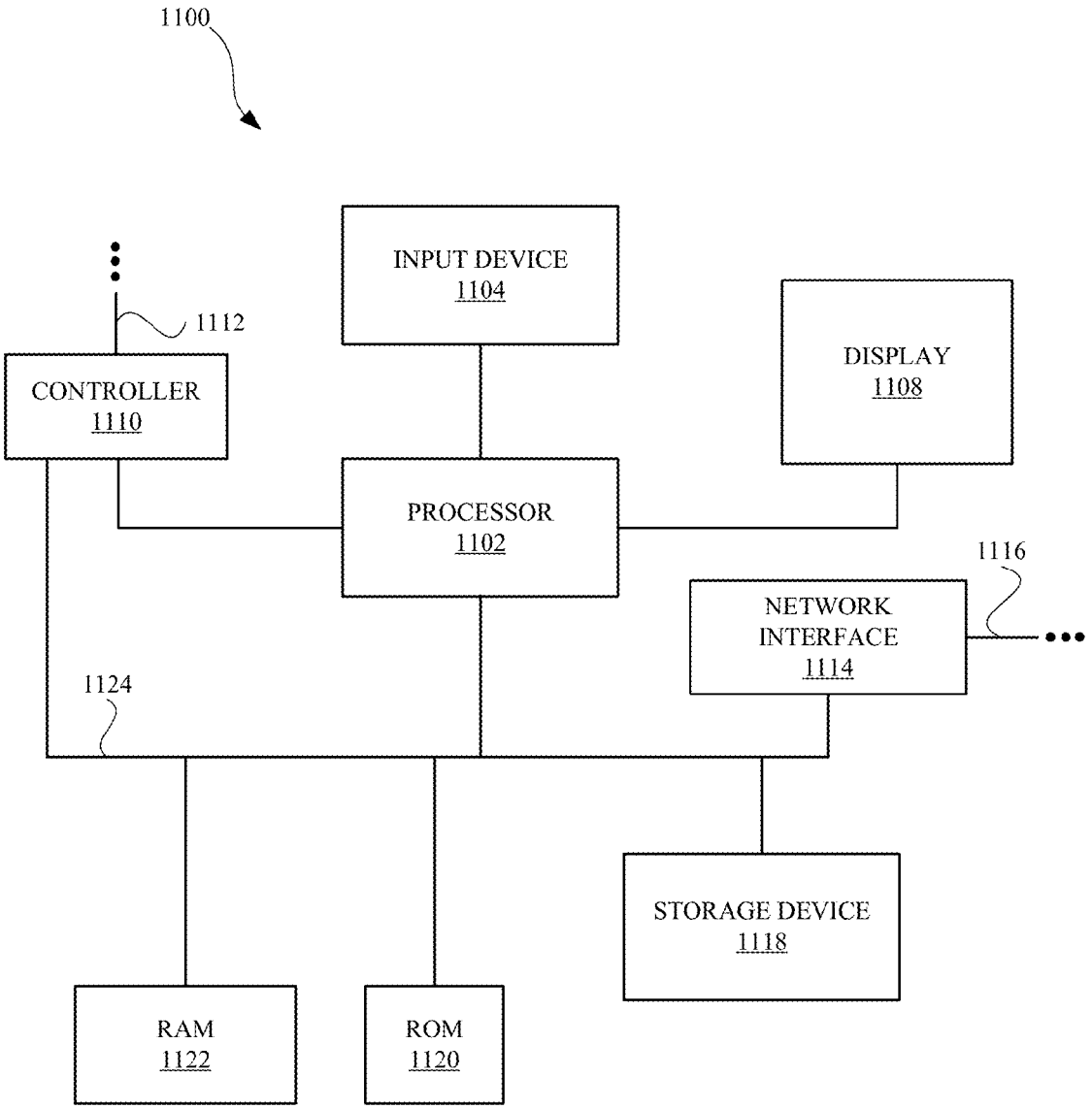
FIG. 11 is a diagram of a computing device that can represent the components of the computing device, display controller, and/or display panel operating, which can operate any of the embodiments discussed herein.

FIG. 11 is a diagram of a computing device 1100 that can represent the components of the computing device 100, processor 201 or 616, and/or display panel 102 operating according any of the embodiments discussed herein. It will be appreciated that the components, devices or elements illustrated in and described with respect to FIG. 11 may not be mandatory and thus some may be omitted in certain embodiments. The computing device 1100 can include a processor 1102 that represents a microprocessor, a coprocessor, circuitry and/or a controller 1110 for controlling the overall operation of computing device 1100. Although illustrated as a single processor, it can be appreciated that the processor 1102 can include a plurality of processors. The plurality of processors can be in operative communication with each other and can be collectively configured to perform one or more functionalities of the computing device 1100 as described herein. In some embodiments, the processor 1102 can be configured to execute instructions that can be stored at the computing device 1100 and/or that can be otherwise accessible to the processor 1102. As such, whether configured by hardware or by a combination of hardware and software, the processor 1102 can be capable of performing operations and actions in accordance with embodiments described herein.

The computing device 1100 can also include user input device 1104 that allows a user of the computing device 1100 to interact with the computing device 1100. For example, user input device 1104 can take a variety of forms, such as a button, keypad, dial, touch screen, audio input interface, visual/image capture input interface, input in the form of sensor data, etc. Still further, the computing device 1100 can include a display 1108 (screen display) that can be controlled by processor 1102 to display information to a user. Controller 1110 can be used to interface with and control different equipment through equipment control bus 1112. The computing device 1100 can also include a network/bus interface 1114 that couples to data link 1116. Data link 1116 can allow the computing device 1100 to couple to a host computer or to accessory devices. The data link 1116 can be provided over a wired connection or a wireless connection. In the case of a wireless connection, network/bus interface 1114 can include a wireless transceiver.

The computing device 1100 can also include a storage device 1118, which can have a single disk or a plurality of disks (e.g., hard drives) and a storage management module that manages one or more partitions (also referred to herein as "logical volumes") within the storage device 1118. In some embodiments, the storage device 1118 can include flash memory, semiconductor (solid state) memory or the like. Still further, the computing device 1100 can include Read-Only Memory (ROM) 1120 and Random Access Memory (RAM) 1122. The ROM 1120 can store programs, code, instructions, utilities or processes to be executed in a non-volatile manner. The RAM 1122 can provide volatile data storage, and store instructions related to components of the storage management module that are configured to carry out the various techniques described herein. The computing device 1100 can further include data bus 1124. Data bus 1124 can facilitate data and signal transfer between at least processor 1102, controller 1110, network/bus interface 1114, storage device 1118, ROM 1120, and RAM 1122.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A method for operating a display, comprising:

receiving a spatial pattern of color values for a frame in a sequence of frames, each color value of the spatial pattern of color values having most significant bits and least significant bits, and the spatial pattern of color values having a spatial pattern of most significant bits and a spatial pattern of least significant bits;

selecting a phase based on a position of the frame in the sequence of frames;

selecting a dither pattern based on the spatial pattern of least significant bits and the selected phase using a phase lookup table;

tracking a first count of a first phase and a second count of a second phase used within a cycle;

bypassing a dither pattern associated with the first phase when the first count exceeds the second count within the cycle; and providing output data that combines the spatial pattern of most significant bits and the dither pattern.

2. The method of claim 1, wherein the dither pattern comprises a spatial pattern of binary values.

3. The method of claim 1, wherein the dither pattern is stored in a lookup table under a group of dither patterns that have multiple phases, and each dither pattern in the group is associated with an individual phase.

4. The method of claim 3, wherein the group of dither patterns includes positive polarity frame dither patterns and negative polarity frame dither patterns that are available alternatively in each frame in the sequence of frames.

5. The method of claim 1, wherein the spatial pattern of color values is associated with a block of pixels, the block of pixels comprises multiple sub-blocks of pixels and the block of pixels is associated with a spatial arrangement of multiple phases, the selecting of the dither pattern for each sub-block of pixels is based on the spatial arrangement of the multiple phases.

6. The method of claim 5, wherein between an odd frame and an even frame in the sequence of frames, the phases are spatially rearranged by 180 degree; and between the odd frame and a next odd frame in the sequence of frames, the phases are spatially rearranged by 90 degree.

7. The method of claim 5, wherein the spatial arrangement of multiple phases is determined by a randomization process.

8. A computing device comprising:

a display panel; and a processor connected to the display panel, the processor configured to compile display output data in accordance with dither patterns that are associated with different phases, the phases are shifted over a sequence of image frames, wherein the display panel is associated with different refresh rates and the processor is further configured to:

track a first count of a first phase is used within a cycle;

track a second count of a second phase is used within the cycle; and bypass a dither pattern associated with the first phase when the first count exceeds the second count within the cycle.

9. The computing device of claim 8, wherein the processor is coupled with a memory that stores a lookup table having entries that provide correspondence between combinations of least significant bits and the dither patterns; and the dither patterns comprises a first group of dither patterns that correspond to positive polarity frames and a second group of dither patterns than correspond to negative polarity frames.

10. The computing device of claim 8, wherein the shifting of the phases comprises rearranging spatial locations of the phases.

11. The computing device of claim 8, wherein the shifting of the phases comprises changing phases associated with a group of pixels over time.

12. The computing device of claim 8, wherein the processor is coupled with a memory that stores a lookup table having entries that provide correspondence between combinations of least significant bits and the dither patterns; and wherein the shifting of the phases comprises changing a first dither pattern of the dither patterns to a second dither pattern of the dither patterns, the first dither pattern is associated with a higher average luminance than the second dither pattern.

13. The computing device of claim 8, wherein the display panel further comprises a first group of pixels of a denser color and a second group of pixels of a less dense color; and the processor is further configured to perform a first spatial dithering horizontally and vertically across the first group of pixels and to perform a second spatial dithering diagonally across the second group of pixels.

14. A system comprising:

a display;

a processor; and a memory that is configured to store instructions that when executed by the processor, cause the system to perform operations comprising:

receiving an input corresponding to a first block of pixel data for the display;

selecting a block dither pattern according to a spatial pattern of least significant bits in the first block of pixel data, wherein each block dither pattern is associated with a phase, wherein the phase is shifted over the sequence of frames;

tracking a first count of a first phase and a second count of a second phase used within a cycle;

bypassing a block dither pattern associated with the first phase when the first count exceeds the second count within the cycle; and outputting, to the display, a sequence of second blocks of pixel data for display by the display over a sequence of frames, each second block of pixel data being based on the block dither pattern.

15. The system of claim 14, wherein the sequence of second blocks of pixel data is associated with a block of 2×2 pixels.

16. The system of claim 14 further comprises a lookup table stored in the memory, the lookup table comprises entries that associate different blocks of pixel data with different groups of dither patterns.

17. The system of claim 14, wherein the sequence of second blocks of pixel data is associated with a block of 4×4 pixels associated with multiple phases, the block of 4×4 pixels comprising sub-blocks of 2×2 pixels, each sub-block of 2×2 pixels associated with an individual phase, and the phases are shifted spatially over the sequence of frames.

18. The system of claim 14, wherein the sequence of second blocks of pixel data is associated with a block of pixels comprising multiple sub-blocks, and each sub-block has a spatial arrangement of phases that is determined by a randomization process.

19. The system of claim 14, wherein the sequence of second blocks of pixel data are associated with a block of pixels that is divided into four quadrants, and four blocks of dither pattern are selected for each second blocks of pixel data, each block of dither pattern is associated with a different phase.

* * * * *